US012557962B1

(12) United States Patent
Li

(10) Patent No.: US 12,557,962 B1
(45) Date of Patent: Feb. 24, 2026

(54) WASTE DISCHARGE DEVICE, DOCKING STATION FOR USE WITH A CLEANING ROBOT, CLEANING SYSTEM AND METHOD OF OPERATING THE DOCKING STATION

(71) Applicant: TP-Link Systems Inc., Irvine, CA (US)

(72) Inventor: Wen Li, Shenzhen (CN)

(73) Assignee: TP-Link Systems Inc., Irvine, CA (US)

( * ) Notice: Subject to any disclaimer, the term of this patent is extended or adjusted under 35 U.S.C. 154(b) by 0 days.

(21) Appl. No.: 18/811,668

(22) Filed: Aug. 21, 2024

(51) Int. Cl.
*A47L 11/40* (2006.01)
*A47L 9/28* (2006.01)

(52) U.S. Cl.
CPC ..... *A47L 11/4025* (2013.01); *A47L 9/2873* (2013.01); *A47L 2201/024* (2013.01)

(58) Field of Classification Search
CPC ..... A47L 9/2873; A47L 11/4013; A47L 11/4016; A47L 11/4025; A47L 2201/02; A47L 2201/024; A47L 2201/026; B02C 2201/06; B02C 2201/063; B02C 18/22; B02C 18/2216; B02C 18/2233; B02C 18/083; F16K 3/085; C02F 1/02; C02F 1/04; C02F 1/06; C02F 2103/002; C02F 2201/001; C02F 2201/002; C02F 2201/005; C02F 2201/007; B01D 1/00; B01D 1/04; B01D 1/14; B01D 3/00; B01D 5/00; B01D 5/003; B01D 5/0057; Y02W 10/00
USPC ..... 251/208, 268
See application file for complete search history.

(56) References Cited

U.S. PATENT DOCUMENTS 3,587,023 A * 6/1971 Goessler ..... H05B 1/0213 337/105
6,156,102 A * 12/2000 Conrad ..... B01D 53/18 95/193
2005/0151106 A1* 7/2005 He ..... F16K 3/08 137/625.46
2009/0071341 A1* 3/2009 Takemasa ..... A61M 16/20 96/116

FOREIGN PATENT DOCUMENTS

CN 203340914 U 12/2013
CN 207940784 U 10/2018
(Continued)

OTHER PUBLICATIONS

Translation of CN 219835566 U (Year: 2023).*
(Continued)

*Primary Examiner* — David S Posigian
*Assistant Examiner* — Steven Huang
(74) *Attorney, Agent, or Firm* — Loeb & Loeb LLP

(57) ABSTRACT

The present disclosure provides a docking station of a cleaning robot, a waste discharge device for use in the docking station, a cleaning system and a method of operating the docking station. The waste discharge device includes: a valve element mounted at a position corresponding to a discharge opening of a wastewater tank of the docking station, the discharge opening being at the bottom of the wastewater tank, the valve element being operable in an open state for uncovering the discharge opening or a closed state for covering the discharge opening; and a mechanism configured to be actuated while the valve element is in the open state to break through solidified waste formed at the discharge opening.

21 Claims, 10 Drawing Sheets

(56) References Cited

FOREIGN PATENT DOCUMENTS

| | | | | | |
|---|---|---|---|---|---|
| CN | 108862436 | A | | 11/2018 | |
| CN | 210871348 | U | * | 6/2020 | ..... A47L 11/4091 |
| CN | 211749314 | U | * | 10/2020 | |
| CN | 214833256 | U | * | 11/2021 | |
| CN | 215725309 | U | | 2/2022 | |
| CN | 114451813 | A | * | 5/2022 | ..... A47L 11/00 |
| CN | 216628432 | U | | 5/2022 | |
| CN | 216221361 | U | | 8/2022 | |
| CN | 115259513 | A | | 11/2022 | |
| CN | 115316898 | A | * | 11/2022 | |
| CN | 115413982 | A | | 12/2022 | |
| CN | 115500751 | A | * | 12/2022 | |
| CN | 115500752 | A | | 12/2022 | |
| CN | 115555381 | A | | 1/2023 | |
| CN | 218279536 | U | * | 1/2023 | |
| CN | 113739419 | B | | 4/2023 | |
| CN | 218884166 | U | | 4/2023 | |
| CN | 219438961 | U | | 8/2023 | |
| CN | 219450259 | U | | 8/2023 | |
| CN | 219742616 | U | | 9/2023 | |
| CN | 116849566 | A | * | 10/2023 | |
| CN | 219835566 | U | * | 10/2023 | |
| CN | 117357003 | A | | 1/2024 | |
| CN | 115413975 | B | | 4/2024 | |
| CN | 115413982 | B | | 6/2024 | |
| EP | 1916459 | A2 | * | 4/2008 | ..... A47J 31/46 |
| WO | WO-2021075751 | A1 | * | 4/2021 | ..... B09B 3/00 |

OTHER PUBLICATIONS

Translation of CN 115316898 A (Year: 2022).*
Translation of CN 218279536 U (Year: 2023).*
Translation of EP 1916459 A2 (Year: 2008).*
Translation of CN 114451813 A (Year: 2022).*
Translation of CN 115500751 A (Year: 2022).*
Translation of WO 2021075751 A1 (Year: 2021).*
Translation of CN 211749314 U (Year: 2020).*
Translation of CN 116849566 A (Year: 2023).*
Translation of CN 210871348 U (Year: 2020).*
Translation of CN 214833256 U (Year: 2021).*
The principle and characteristics of rotary dehumidification, 6 pages (including English translation) dated Nov. 6, 2021.
United States Patent and Trademark Office, Non-Final Office Action of U.S. Appl. No. 19/083,398, filed May 27, 2025, 12 pages.
United States Patent and Trademark Office, Non-Final Office Action of U.S. Appl. No. 19/083,397, filed Jun. 13, 2025, 20 pages.
Subtitles for the video titled " Basic Mechanisms: Leadscrew," Aug. 8, 2022. The video can be found at https://www.youtube.com/watch?v=tkOhH9OUMto. 1 page.
USPTO, Non-Final Office Action dated Aug. 15, 2025 for U.S. Appl. No. 19/083,419, 22 pages.

* cited by examiner

WASTE DISCHARGE DEVICE, DOCKING STATION FOR USE WITH A CLEANING ROBOT, CLEANING SYSTEM AND METHOD OF OPERATING THE DOCKING STATION

TECHNICAL FIELD

The present disclosure relates the technical field of autonomous cleaning, and specifically, to a docking station of a cleaning robot, a waste discharge device for use in the docking station, a cleaning system and a method of operating the docking station.

BACKGROUND

Autonomous cleaning robots have gained widespread adoption across residential homes, offices, and industrial settings for their ability to perform sweeping and/or mopping tasks on various floor surfaces. These robots, commonly known as robotic vacuum cleaners or floor cleaners, are designed to autonomously navigate and clean designated areas before returning to their charging and docking stations. Upon completion of a cleaning cycle, the cleaning robot returns to the docking station, where it transfers the collected dry debris into a dustbin of the docking station and undergoes a cleaning process for its mopping pads.

Existing docking stations offer the convenience of automatic cleaning of the mopping pads by supplying clean water stored in a clean water tank to rinse the mopping pads and collecting the used water into a wastewater tank. However, the requirement for periodic manual replenishment of the clean water tank and emptying of the wastewater tank can be inconvenient and laborious for users, and the wastewater stored in the wastewater tank for extended periods is prone to developing unpleasant odors, which not only affects the user experience but also necessitates frequent and unpleasant cleaning tasks.

There is a need for an improved mechanism for handling the wastewater generated from cleaning the mopping pads at the docking station to enhance the user experience.

SUMMARY

In view of the above technical problems, the present disclosure provides a docking station of a cleaning robot, a waste discharge device for use in the docking station, a cleaning system and a method of operating the docking station to enhance the user experience while recycling water.

According to one embodiment of the present disclosure, there is provided a waste discharge device for use in a docking station of a cleaning robot, the docking station having a wastewater tank with a discharge opening at its bottom, the waste discharge device comprising: a valve element mounted at a position corresponding to the discharge opening, the valve element being operable in an open state for uncovering the discharge opening or a closed state for covering the discharge opening; and a mechanism configured to be actuated while the valve element is in the open state to break through solidified waste formed at the discharge opening.

According to another embodiment of the present disclosure, there is provided a docking station for a cleaning robot, the docking station comprising: a clean water tank configured to store a supply of clean water; a wastewater tank configured to collect wastewater and having a discharge opening at its bottom; and a waste discharge device comprising: a valve element mounted at a position corresponding to the discharge opening, the valve element being operable in an open state for uncovering the discharge opening or a closed state for covering the discharge opening; and a mechanism configured to be actuated while the valve element is in the open state to break through solidified waste formed at the discharge opening.

According to yet another embodiment of the present disclosure, there is provided a method of operating a docking station of a cleaning robot, the docking station having a wastewater tank with a discharge opening at its bottom, the method comprising: collecting wastewater in the wastewater tank; distilling, by using a heater, the wastewater stored in the wastewater tank for generating clean water to be stored in a clean water tank of the docking station; controlling a valve element to be in an open state for uncovering the discharge opening, the valve element being mounted at a position corresponding to the discharge opening; and actuating a mechanism while the valve element is in the open state to break through solidified waste formed at the discharge opening.

According to still another embodiment of the present disclosure, there is provided a computer program product for operating a docking station of a cleaning robot, the computer program product comprising a non-transitory computer readable storage medium having program instructions embodied therewith, the program instructions executable by a processor of the docking station to cause the docking station to perform the operations of: collecting wastewater in the wastewater tank; distilling, by using a heater, the wastewater stored in the wastewater tank for generating clean water to be stored in a clean water tank of the docking station; controlling a valve element to be in an open state for uncovering the discharge opening, the valve element being mounted at a position corresponding to the discharge opening; and actuating a mechanism while the valve element is in the open state to break through solidified waste formed at the discharge opening.

According to still another embodiment of the present disclosure, there is provided a cleaning system, comprising: a cleaning robot configured to perform a cleaning task; and a docking station for the cleaning robot. The docking station comprising: a clean water tank configured to store a supply of clean water; a wastewater tank configured to collect wastewater and having a discharge opening at its bottom; and a waste discharge device comprising: a valve element mounted at a position corresponding to the discharge opening, the valve element being operable in an open state for uncovering the discharge opening or a closed state for covering the discharge opening; and a mechanism configured to be actuated while the valve element is in the open state to break through solidified waste formed at the discharge opening.

At least based on the above embodiments of the present disclosure, an improved mechanism for handling the wastewater generated from cleaning the mopping pads and for handling the solidified waste generated from the distillation of the wastewater at the docking station to enhance the user experience while recycling water resources.

BRIEF DESCRIPTION OF THE DRAWINGS

The above and other objects, features and advantages of the present disclosure will become more apparent by describing embodiments of the present disclosure in more detail in conjunction with accompanying drawings. The drawings are used to provide a further understanding of the embodiments of the present disclosure and constitute a part of the specification. The drawings together with the embodiments of the present disclosure are used to explain the present disclosure, but do not constitute a limitation on the present disclosure. In the drawings, unless otherwise explicitly indicated, the same reference numerals refer to the same components, steps or elements.

DETAILED DESCRIPTION

Figure 1:
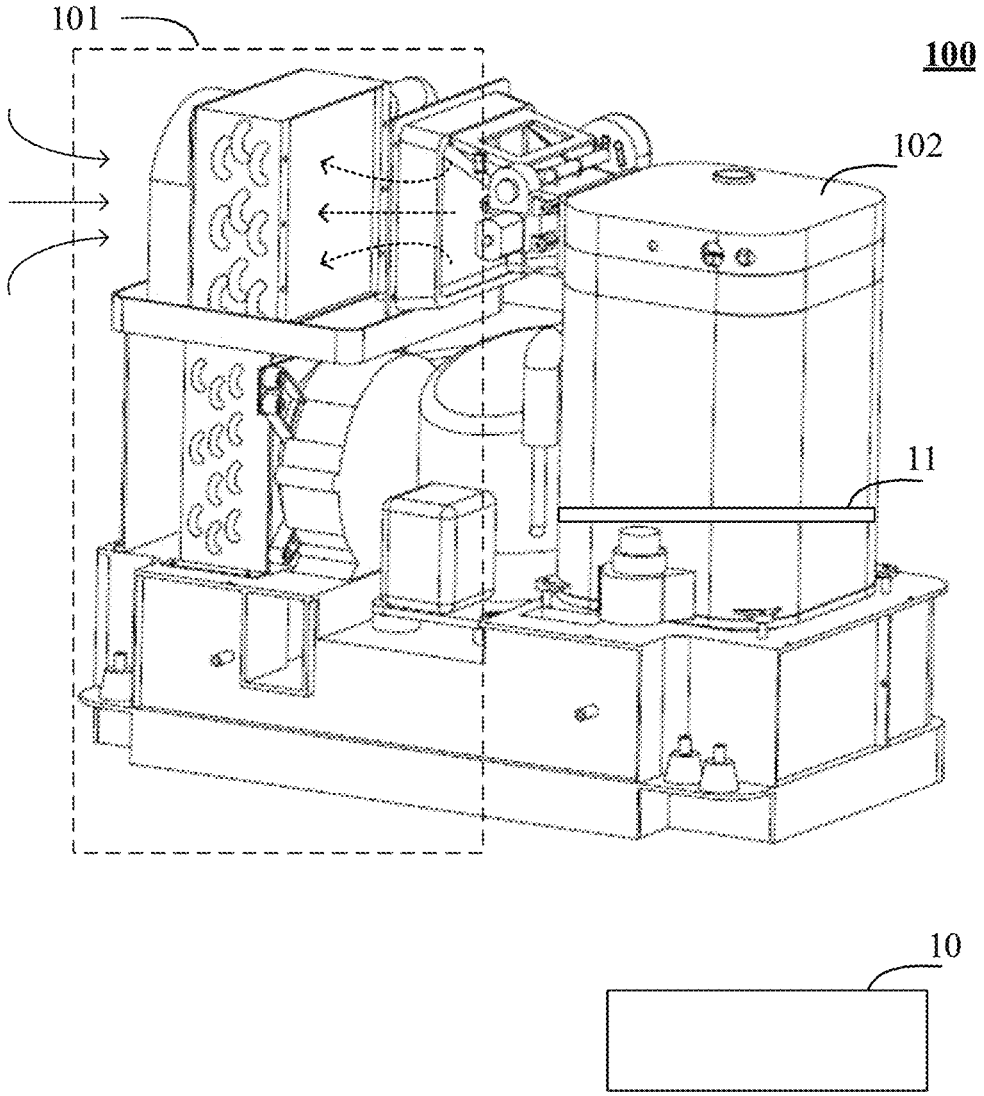
FIG. 1 shows an exemplary schematic diagram of a docking station of a cleaning robot according to an embodiment of the present disclosure.

The technical solution of the present disclosure will be clearly and completely described below in conjunction with accompanying drawings. Obviously, the described embodiments are part of embodiments of the present disclosure, but not all of them. Based on the embodiments in the present disclosure, all other embodiments obtained by ordinary skilled in the art without making any creative efforts fall within the scope of protection of the present disclosure.

In the description of the present disclosure, it should be noted that orientations or positional relationships indicated by terms such as "center", "upper", "lower", "left", "right", "vertical", "horizontal", "top", "bottom", "internal", "external", "inside" and "outside" are based on orientations or positional relationships shown in the drawings, only for the convenience of describing the present disclosure and simplifying the description, instead of indicating or implying the indicated device or element must have a particular orientation. In addition, terms such as "first", "second" and "third" are only for descriptive purposes, and cannot be understood as indicating or implying relative importance. Likewise, words like "a", "an" or "the" do not represent a quantity limit, but represent an existence of at least one. Words like "include" or "comprise" mean that an element or an object in front of the said word encompasses those ones listed following the said word and their equivalents, without excluding other elements or objects. Words like "connect" or "link" are not limited to physical or mechanical connections, but may include electrical connections, whether direct or indirect connections.

In the description of the present disclosure, it should be noted that, unless otherwise explicitly specified and limited, terms such as "mount", "link" and "connect" should be understood in a broad sense. For example, such terms may refer to being fixedly connected, or detachably connected, or integrally connected; may refer to being mechanically connected, or electrically connected; may refer to being directly connected, or indirectly connected via an intermediate medium, or internally connected inside two elements. For ordinary skilled in the art, the meanings of the above terms in the present disclosure may be understood on a case-by-case basis.

In addition, technical features involved in different embodiments of the present disclosure may be combined with each other as long as no conflicts occurs therebetween.

Traditional solutions for docking stations of autonomous cleaning robots, aiming to facilitate user convenience by eliminating the need for clean water replacement and wastewater discharge, have often relied on the installation of complex plumbing systems. These systems automate the process of replenishing clean water and discharging wastewater. However, a significant limitation is the requirement for suitable installation sites with appropriate piping and space, which many households lack, thus preventing the installation of such systems. To overcome these challenges, the present disclosure proposes an improved solution for docking stations of autonomous cleaning robots that automatically handles wastewater and generates clean water, enabling an effective water recycle.

FIG. 1 shows an exemplary schematic diagram of a docking station of a cleaning robot 10 according to an embodiment of the present disclosure.

As depicted in FIG. 1, the docking station 100, according to an embodiment of the present disclosure, is designed with the capability to autonomously process wastewater and produce clean water, which eliminates the need for manual operations of clean water replacement and wastewater discharge. As shown in FIG. 1, the docking station 100 comprises a wastewater tank 102, which collects the wastewater generated from washing the mopping pads of the cleaning robot, e.g., after the cleaning robot 10 finishes a current cleaning cycle and docks at the docking station 100. The wastewater can be distilled at the wastewater tank 102 for generating clean water, which can be later stored in a clean water tank of the docking station 100 (which is configured to hold a supply of clean water) and/or supplied to the cleaning robot 10 for a next cleaning cycle.

Accordingly, the wastewater tank 102 incorporates an evaporation or distillation mechanism that facilitates the removal of water content, leading to the concentration of solid waste, which remains at the bottom of the wastewater tank 102. The solid waste is processed, for example, by a rotating blade for scraping or a pulverizing mechanism for breaking it into smaller pieces, which can be discharged as dry debris through a discharge opening provided at the bottom of the wastewater tank 102 and collected in a dust collection box positioned beneath the wastewater tank 102. Consequently, users only need to periodically empty the dust collection box of dry debris, eliminating the need to remove the wastewater tank 102 and dispose the wastewater.

Additionally, the docking station 100 includes a clean water generation device 101, tasked with generating clean water from water vapor, which can be based on one or more of condensation and moisture absorption mechanisms. Consequently, the clean water generation device 101 can receive the water vapor produced by the distillation of the wastewater in the wastewater tank 102 (as indicated by the three dashed-line arrows of FIG. 1) and/or the water vapor originated from the moisture in the air (as indicated by the three solid-line arrows of FIG. 1), which can be used as sources of water vapor for generating clean water. This process results in the creation of clean water, which is then stored in the clean water tank or supplied to the cleaning robot 10, as mentioned above. In this manner, the wastewater generated from the process of washing the mopping pads and ambient humidity are effectively utilized, allowing users to forgo the disposal of wastewater and manual addition of clean water, thus achieving an efficient recycling of water resources and reducing the operational burden on the user.

It should be noted that FIG. 1 only illustrates the main components of the docking station 100, such as the clean water generation device 101 and the wastewater tank 102 in a schematic way, however, the docking station 100 may also incorporate other structures or components not depicted in FIG. 1. In addition, the structures and connections shown in FIG. 1 are exemplary and alternative configurations may also be used. The present disclosure does not limit the details of the structures and their interconnections for the docking station 100.

In the context of the present disclosure, which employs the distillation approach to purify wastewater for water recycling at the docking station, the inventors have recognized the following problem. Although the distillation process can produce hot steam that is subsequently condensed to create purified liquid water, there is a challenge associated with the disposal of solid waste left after the wastewater has been evaporated. For example, when the wastewater dries up, the solid waste remains at the bottom of the wastewater tank (which is also referred to as an evaporation dish). The solidified waste can be relatively hard and thick, and may not be entirely removable by the rotating blade or the pulverizing mechanism, potentially blocking the discharge opening of the wastewater tank, which is designed for the discharge of solid waste. This can lead to the obstruction of the discharge path of the dry debris, affecting the efficiency of waste removal and may trigger a product fault. In this case, users are compelled to manually inspect the bottom of the wastewater tank to clear the blockage, or return the docking station to the service center for maintenance (e.g., if users have no access to the inside of the wastewater tank), thereby causing inconvenience.

In view of at least the above problem, the overall concept of the present disclosure is to employ a mechanical opening/closing device that operates in conjunction with a mechanism capable of being actuated, to clear the solidified waste obstructing the discharge opening of the wastewater tank. For example, in case that the mechanism is implemented as a telescopic device, the mechanical opening/closing device may operate horizontally in conjunction with the telescopic device that operates vertically, to clear the solidified waste. It should be noted that various mounting positions and actuation directions of the mechanical opening/closing device and/or the telescopic device are possible, as long as the cooperation of the two devices may allow the telescopic rod to be guided through the opening by extending or retracting its length to penetrate the dirt.

According to embodiments of the present disclosure, the mechanical opening/closing device is exemplified by a valve element at a position corresponding to the discharge opening, and the valve element is operable between an open state for uncovering the discharge opening and a closed state for covering the same. The telescopic device is exemplified by a telescopic mechanism movable between a retracted position and an extended position. For example, the valve element is mounted on an external bottom surface of the wastewater tank, and the telescopic mechanism is disposed above the discharge opening inside the wastewater tank or disposed below the discharge opening outside the wastewater tank, and movable vertically between the retracted position and the extended position, which will be described in details hereinafter. To efficiently prevent the discharge opening from being blocked by the solidified waste generated from the distillation of wastewater, the telescopic mechanism is controlled to transition from the retracted position to the extended position while the valve element is in the open state, thereby breaking through the solidified waste formed at the discharge opening of the wastewater tank.

In this manner, the valve element can be maintained in the closed state and the telescopic mechanism can be maintained in the retracted position when not discharging solid waste, preventing leakage of wastewater and maintaining the sealing. Once the wastewater has evaporated and solidified waste is formed and there is a need to discharge the solid waste, the valve element can be switched to the open state and the telescopic mechanism can be extended to its full length at the extended position, to break up the solidified waste at the valve element, allowing the dry debris, such as the solidified waste which has been crushed by the rotating blade, to be collected into the dust collection box through the unobstructed discharge opening, thus avoiding blockages that would prevent the discharge of dry debris.

It should be noted that, in addition to the telescopic device or equivalently the telescopic mechanism, the mechanism capable of being actuated can be implemented in other ways, such as a high-velocity airflow mechanism or an enclosed pressurization mechanism, among other examples. In this manner, the valve element can be maintained in the closed state and the mechanism can be maintained in the unactuated state (e.g., a first state for which no airflow is directed to the discharge opening) when not discharging solid waste. Once the wastewater has evaporated and solidified waste is formed and there is a need to discharge the solid waste, the valve element can be switched to the open state and the mechanism can be switched to the actuated state (e.g., a second state for which airflow is directed to the discharge opening), to break up the solidified waste at the valve element.

For example, the mechanism capable of being actuated can be implemented as a high-velocity airflow system in addition to or other than the above-mentioned telescopic mechanism. The high-velocity airflow system comprises a pressurization device installed within the system, which generates a high-velocity airflow, and the pressurization device is connected to a conduit leading to a nozzle positioned near the discharge opening. When the solidified waste at the discharge opening needs to be cleared, the pressurization device is activated, directing a high-velocity airflow through the conduit to the nozzle. Meanwhile, the valve element can be opened to expose the discharge opening, to allow the airflow to directly impact the solidified waste formed of the discharge opening. This process effectively breaks up and clears the solidified waste, facilitating its removal through the discharge opening.

As another example, an enclosed pressurization system can be used, which incorporates a pressurization device that, when activated, increases the pressure within the valve chamber. The valve element, which is mounted in correspondence to the discharge opening, is designed to be impermeable to the pressurized environment, ensuring that the force is concentrated on the solidified waste. Upon opening the valve element, the pressurized air is released, exerting a powerful force against the accumulated waste, such that the waste can be cleared efficiently after the mechanism is actuated.

It should be noted that the above mentioned actuable mechanisms based on high-velocity airflow or enclosed pressurization, as well as other types of actuable mechanisms are also possible. In the implementations involving a pressurization device connected to a guide tube, when the pressurization device is activated, it can emit a high-speed air jet through the guide tube. When the valve element is opened, the guide tube is connected to the valve opening and forms a seal. At this point, high-speed air is jetted into the valve cavity or continuous pressure is applied until the dirt at the discharge opening is broken through with the aid of the airflow or increased pressure.

The process of wastewater treatment and solid waste discharge at the docking station is described as follows. First, the cleaning robot 10 returns to the docking station to undergo a mopping pad cleaning procedure, which generates wastewater. In this process, the dry debris collected by the cleaning robot 10 during its cleaning mission is also transferred to the dust collection box of the docking station. Then, a heater is started to induce evaporation of the wastewater and the hot steam generated is directed into the clean water generation device 101, where it condenses to form clean, distilled liquid water. During the evaporation or distillation, solidified waste is generated at the bottom of the wastewater tank, and the valve element operates in conjunction with the telescopic mechanism to break through the solidified waste formed at the discharge opening of the wastewater tank, such that the dry debris generated by the rotating blade or the pulverizing mechanism can be easily discharged through the cleared discharge opening of the wastewater tank and collected in the dust collection box by gravity.

Figure 2:
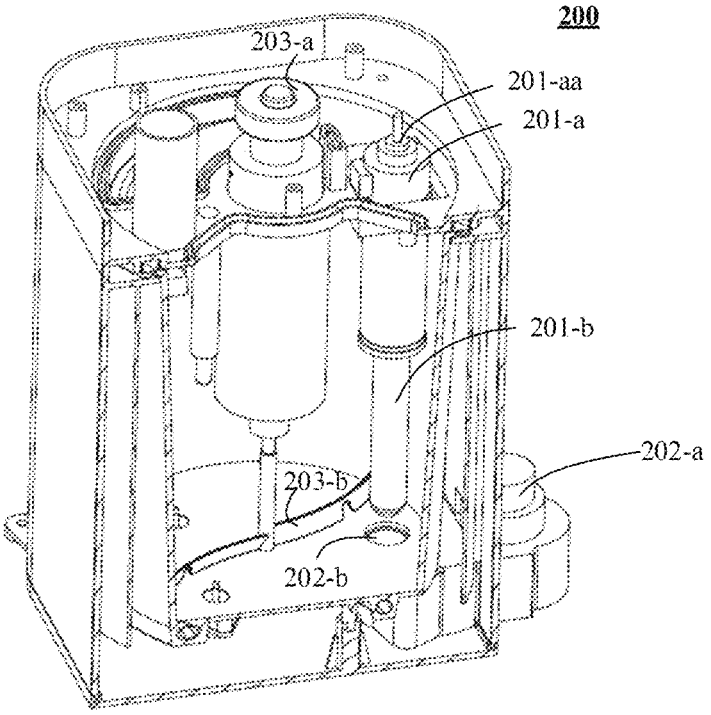
FIG. 2 shows an exemplary schematic diagram of a waste discharge device for use in a docking station according to an embodiment of the present disclosure.

FIG. 2 shows an exemplary schematic diagram of a waste discharge device for use in a docking station according to an embodiment of the present disclosure.

With reference to FIG. 2, the waste discharge device 200 is positioned in relation to the wastewater tank to efficiently handle the solidified waste resulting from the distillation. As depicted, the waste discharge device 200 comprises a telescopic mechanism, which includes a first actuator 201-*a* that provides the motive power for the extension and retraction of the telescopic mechanism, and a push-pull rod 201-*b* that moves in response to the actuation of the first actuator 201-*a*. In this example, the push-pull rod 201-*b* moves vertically to retract or extend its length. When there is no need to discharge the dry debris through the discharge opening, the push-pull rod 201-*b* is in the retracted position, whereas it extends to the extended position to break through the solidified waste when necessary.

The waste discharge device 200 further includes a valve element, comprising a second actuator 202-*a* that supplies the motive power needed for the actuation of the valve element, and a movable part 202-*b* that controls the opening and closed states of the valve element in response to the actuation of the second actuator 202-*a*. When there is no need to discharge the dry debris through the discharge opening, the movable part 202-*b* is in the closed state to seal the liquid, whereas it switches to the open state to allow the push-pull rod 201-*b* to extend through the discharge opening, thereby shattering the dried mud formed at the discharge opening of the wastewater tank and clearing the discharge path of dry debris.

The waste discharge device 200 further includes a waste crushing mechanism, which includes a third actuator 203-*a* that supplies the motive power for scraping or pulverizing the solidified waste, and a set of blades 203-*b* that rotates under the actuation of the third actuator 203-*a* to crush the waste into smaller pieces, fine particles or powder. In this way, the dry debris can be easily discharged through the cleared discharge opening.

In this embodiment, the first actuator 201-*a* comprises a first motor 201-*aa* and a transmission mechanism mechanically connected to the first motor 201-*aa* wherein the transmission mechanism may be configured to translate a rotational movement of the first motor 201-*aa* into a linear movement of the first actuator 201-*a*. In an example, the transmission mechanism may be implemented by using a gear engaged with a threaded rod, to convert rotational motion into linear motion. Accordingly, the push-pull rod 201-*b* is mechanically connected to the first actuator 201-*a* and driven by the linear movement of the first actuator 201-*a* to move vertically between the retracted position and the extended position.

Accordingly, the solidified waste generated from the distillation of wastewater and formed at the discharge opening of the wastewater tank can be shattered, without the requirements of checking and clearing the blockage of the discharge opening manually or the requirements of visiting a maintenance facility for cleanup, improving the efficiency of dry debris management and enhancing user experience.

Figure 3:
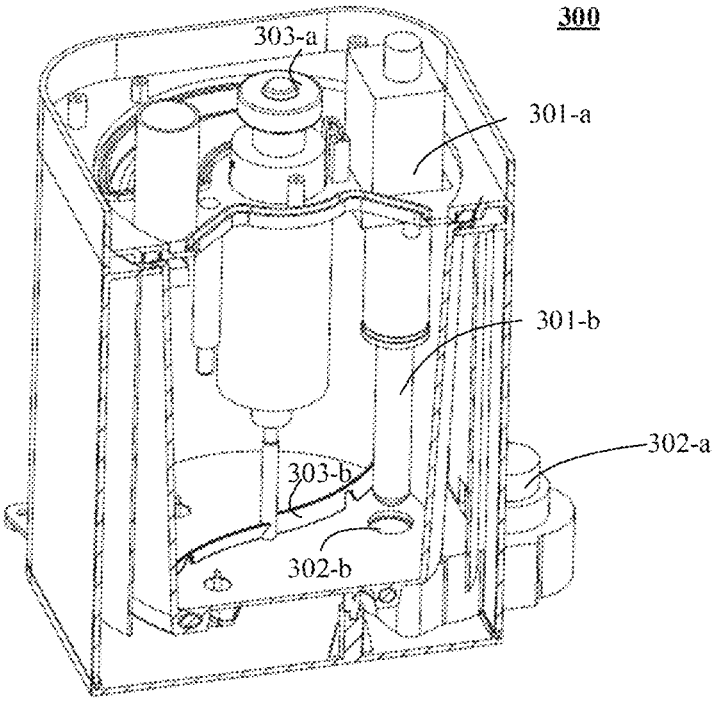
FIG. 3 shows an exemplary schematic diagram of a waste discharge device for use in a docking station according to another embodiment of the present disclosure.

FIG. 3 shows an exemplary schematic diagram of a waste discharge device for use in a docking station according to another embodiment of the present disclosure.

Referring to FIG. 3, the waste discharge device 300 is also positioned in relation to the wastewater tank to efficiently handle the solidified waste resulting from the distillation process. Similar to the waste discharge device 200 depicted in FIG. 2, the waste discharge device 300 also comprises a telescopic mechanism, which includes a first actuator 301-*a* that provides the motive power for the extension and retraction of the telescopic mechanism, and a push-pull rod 301-*b* that moves in response to the actuation of the first actuator 301-*a*. In this example, the push-pull rod 301-*b* also moves vertically to retract or extend its length. The waste discharge device 300 further includes a valve element, which comprises a second actuator 302-*a* and a movable part 302-*b* controlling the opening and closed states of the valve element in response to the actuation of the second actuator 302-*a*. Furthermore, the waste discharge device 300 includes a waste crushing mechanism, which includes a third actuator 303-*a* and a set of blades 303-*b* rotates under the actuation of the third actuator 303-*a* to crush the waste into smaller pieces, fine particles, or powder.

In this embodiment, the valve element and the waste crushing mechanism are identical to the corresponding components depicted in FIG. 2, and details for the components are omitted here. The distinction between FIG. 2 and FIG. 3 lies in the design of the telescopic mechanism. Herein, the vertical movement of the telescopic mechanism is achieved by use of an electromagnet and a spring. When the electromagnet is not energized, it does not generate a magnetic attraction force, and the push-pull rod is pushed to the bottom (i.e., the extended position) by the spring force. Conversely, when the electromagnet is energized, it produces the magnetic attraction force that exceeds the spring force, drawing the push-pull rod upwards (i.e., the retracted position) and compressing the spring, thereby facilitating the extension and retraction of the telescopic mechanism in the vertical direction.

For example, the first actuator 301-*a* is realized by a combination of an electromagnet that generates a magnetic attraction force when energized, and a spring element that generates an elastic force when compressed. Accordingly, the magnetic push-pull rod 301-*b* is mechanically connected to the spring element and is driven by the magnetic attraction force of the electromagnet or the elastic force of the spring element to move vertically between the retracted position and the extended position. For example, when it is needed to discharge the dry debris (and possibly needed to break through the dried waste formed at the discharging opening of the wastewater tank), the electromagnet is not energized, and the elastic force of the spring element causes the magnetic push-pull rod 301-*b* to move to the extended position to cross over and clear the discharging opening, whereas when there is no need to discharge the dry debris, the electromagnet is energized and the generated elastic force of the spring element, which is greater than the elastic force of the spring element, causes the magnetic push-pull rod 301-*b* to return to the retracted position.

It is understood that the above example is described taking the electromagnetic attraction force generated when the electromagnet is energized as an example. However, in other examples, the switching between the retracted position and the extended position can also be achieved by setting opposite polarities on the electromagnet and the magnetic push-pull rod, utilizing the combined action of electromagnetic repulsion force and spring force. The present disclosure does not limit the specific control manners of the electromagnet.

Accordingly, the solidified waste generated at the discharge opening of the wastewater tank can be shattered and effectively cleared without manual operations.

Figure 4A:
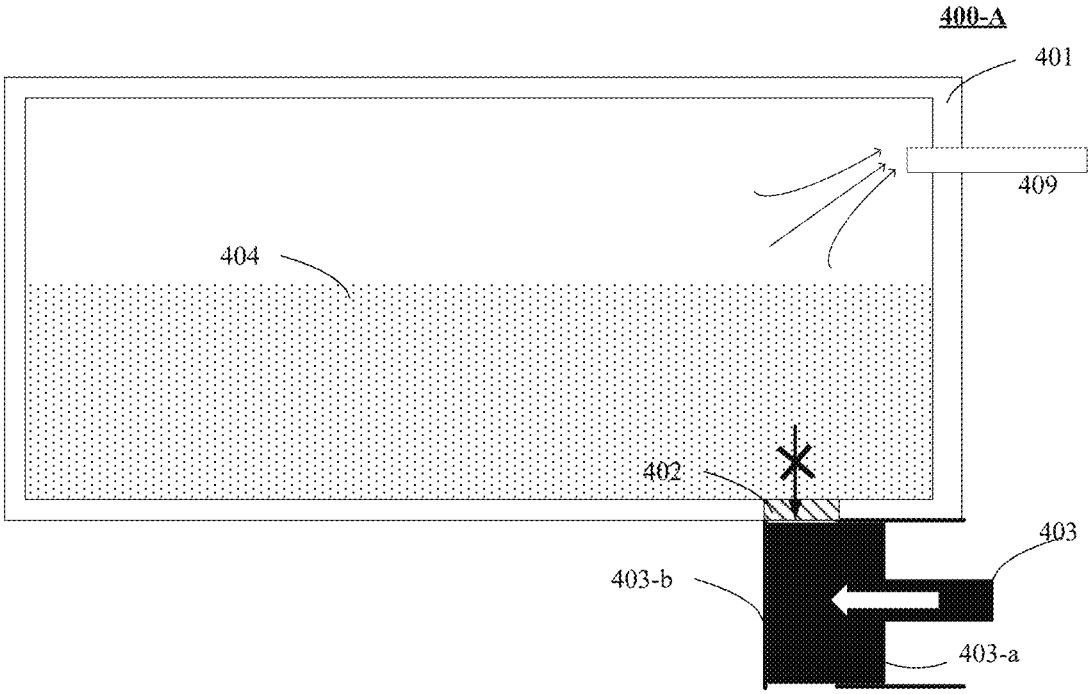
FIGS. 4A-4B show an exemplary schematic diagram of different operation modes of a waste discharge device according to an embodiment of the present disclosure.
Figure 4B:
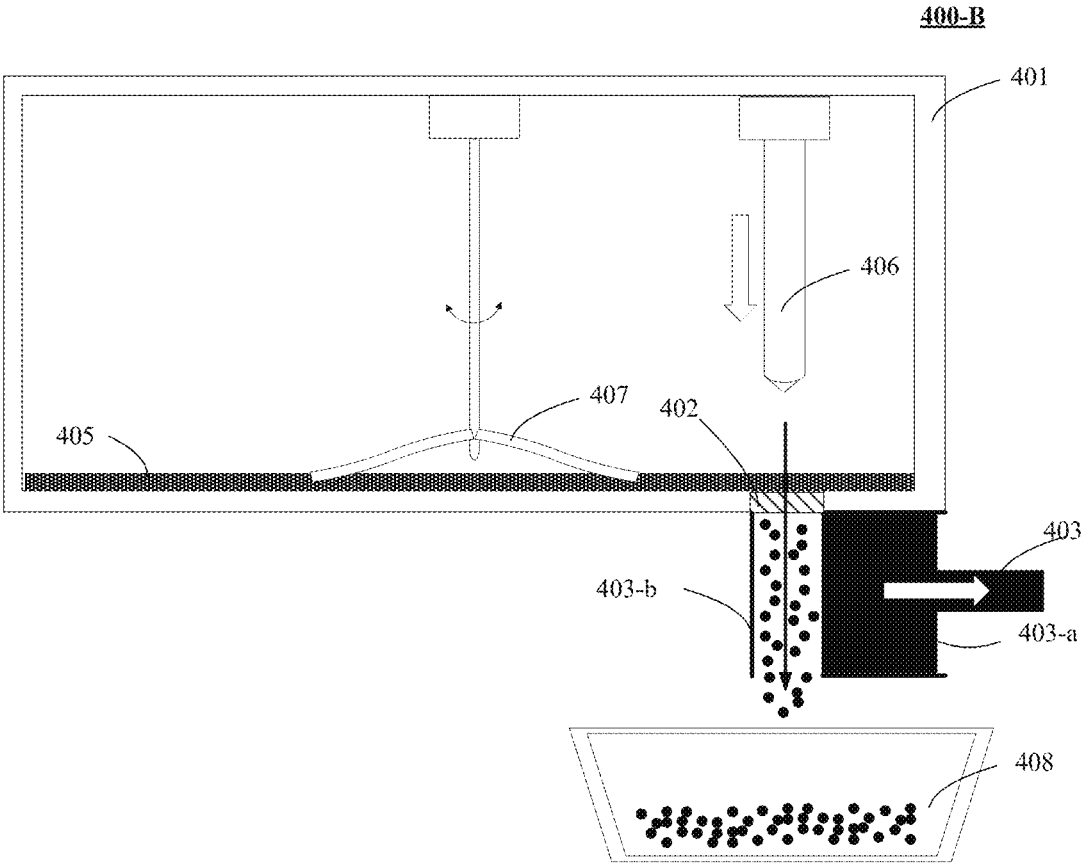

FIGS. 4A-4B show an exemplary schematic diagram of different operation modes of a waste discharge device according to an embodiment of the present disclosure.

In the present embodiment, the valve element as mentioned above is implemented by a solenoid valve, enabling horizontal opening and closed control of the valve element to regulate its open state (as illustrated in FIG. 4B) and closed state (as depicted in FIG. 4A).

FIG. 4A illustrates the waste discharge device in a non-charge mode 400-A, for which no dry debris is discharged. As depicted, the wastewater tank 401 collects wastewater 404 generated from cleaning the mopping pads of the cleaning robot 10, and then heats the wastewater 404 using a heater, such as a heating strip 11 shown in FIG. 1, to produce hot steam that is expelled through a pipe 409 to the clean water generation device 101, which generates the clean water from the water vapor of the hot steam. The wastewater tank 401, as described earlier, has a discharge opening 402 at the bottom for discharging the solid waste produced after distillation. In the non-charge mode 400-A, the solenoid valve 403 is energized, the piston 403-*a* is propelled by magnetic force to make a tight seal with the valve inner wall 403-*b*, closing the valve to cover the discharge opening and preventing liquid from flowing through the opening.

FIG. 4B illustrates the waste discharge device in a charge mode 400-B, for which the dry debris is discharged. As depicted, the wastewater 404 is evaporated to form a layer of dried mud 405 at the bottom of the wastewater tank 401, which may adhere to the discharge opening 402 and obstruct the passage for discharging dry debris. In the charge mode 400-B, the solenoid valve 403 is de-energized, the piston 403-*a* disengages from contact with the valve inner wall 403-*b*, placing the solenoid valve in an open state to uncover the discharge opening. In this case, the telescopic mechanism 406 can be controlled to transition from a retracted position to an extended position, breaking through the solidified waste formed at the discharge opening, thereby clearing the discharge opening 402. Accordingly, a set of blades 407 can rotate to pulverize the dried mud 405, allowing the crushed waste to be discharged into the dust collection box 407 through the cleared discharge opening 402 by gravity.

It is understood that the above description takes a normally open solenoid valve 403 as an example, but a normally closed solenoid valve or other types of electronically controlled valves can also be employed to control the horizontal opening and closed states of the valve element. The present disclosure is not limited to the specific type of solenoid valve used. It should be noted that the sizes, positional relationships, and mounting positions of the components depicted in FIGS. 4A-4B are also exemplary and illustrative. Alternative arrangements and configurations are also possible. Furthermore, the lengths of the blades shown in FIGS. 4A-4B are provided as illustrative examples. In practice, the length of the blades can be extended across the entire bottom surface of the wastewater tank to effectively scrape and remove the dried waste formed across the entire bottom surface.

However, the inventors have observed that the solenoid valve depicted in FIGS. 4A-4B is more suitable for clean liquids free of solid impurities. In scenarios involving the discharge of solid waste, such solids can adhere to the mating surfaces of the valve, such as the valve inner wall 403-*b*, causing the originally smooth contact surfaces to become rough. Consequently, when the valve is switched to its closed state, gaps may remain between the mating surfaces, compromising the sealing integrity. Therefore, an optimized valve structure is required to address the need for solid waste discharge, ensuring effective control of its opening and closed states while maintaining scaling performance.

Figure 5A:
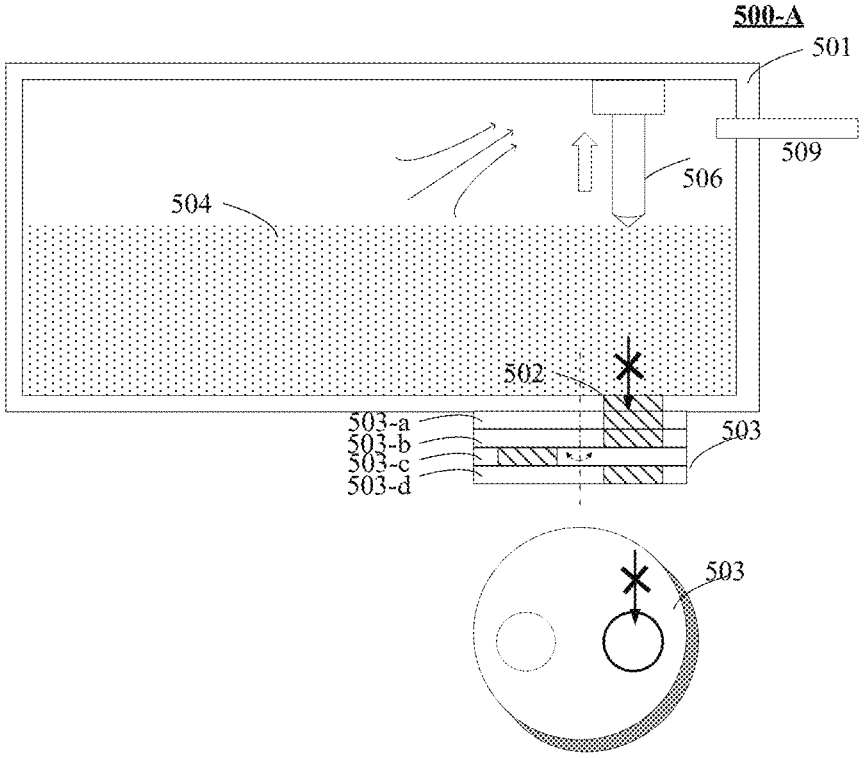
FIGS. 5A-5B show an exemplary schematic diagram of different operation modes of a waste discharge device according to another embodiment of the present disclosure.
Figure 5B:
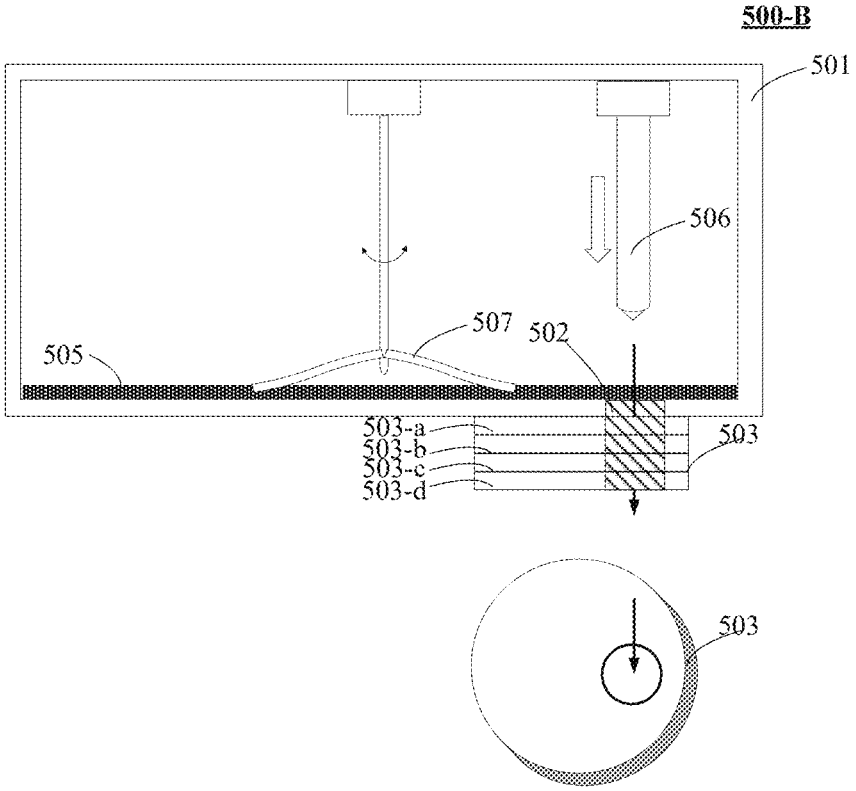

FIGS. 5A-5B show an exemplary schematic diagram of different operation modes of a waste discharge device according to another embodiment of the present disclosure.

In the present embodiment, the valve element is implemented by a flat valve (or referred to as a planar valve), enabling horizontal opening and closed control of the valve element to be in open state (as illustrated in FIG. 5B) or closed state (as depicted in FIG. 5A).

FIG. 5A illustrates the waste discharge device in a non-charge mode 500-A, for which no dry debris is discharged. As depicted, the wastewater tank 501 collects and heats wastewater 504 to produce hot steam that is expelled through a pipe 509. The wastewater tank 501, as described earlier, has a discharge opening 502 at the bottom for discharging the solid waste produced after distillation. In the non-charge mode 500-A, the planar valve 503 is controlled in the closed state to cover the discharge opening and prevent liquid leakage, and the telescopic mechanism 506 is maintained in its retracted position.

FIG. 5B illustrates the waste discharge device in a charge mode 500-B, for which the dry debris is discharged. As depicted, the wastewater 504 is evaporated to form a layer of dried mud 505 at the bottom of the wastewater tank 501, which may adhere to the discharge opening 502 and obstruct the passage for discharging solid waste. In the charge mode 500-B, the valve element 503 is controlled in its open state to uncover the discharge opening. Although the discharge opening may be uncovered, there may be the layer of dried mud 505 obstructing the passage for discharging solid waste through the discharge opening 502. In this case, the telescopic mechanism 506 can be controlled to transition from a retracted position to an extended position, breaking through the solidified waste formed at the discharge opening. Accordingly, a set of blades 507 can rotate to pulverize the dried mud 505, allowing the crushed waste to be discharged through the cleared discharge opening 502 by gravity.

According to the embodiment of the present disclosure, utilizing gravity to facilitate the descent of the crushed dry debris into the dust collection box eliminates the need for complex vacuum systems, thereby effectively reducing the size and cost of the docking station, as well as diminishing the noise associated with waste extraction. This approach achieves waste discharge and collection in a simple and efficient manner.

It is understood that the telescopic mechanism 506 and waste crushing mechanism (including the blades 507) of FIGS. 5A and 5B are identical to the corresponding structures depicted in FIGS. 4A and 4B, and details for the components are omitted here. The distinction between FIGS. 4A and 4B and FIGS. 5A and 5B lies in the design of the valve element. Herein, the valve element 503 implemented by a flat valve or a planar valve, which includes several circular plates arranged in a stack along a common axis, can effectively address the abrasion issue for the mating surfaces of the solenoid valve involved in the solid waste discharge, ensuring effective control of its opening and closed states while maintaining sealing.

As depicted, the valve element 503 comprises a first stationary plate 503-*b* and a second stationary plate 503-*d*, each of the first and second stationary plates 503-*b* and 503-*d* has a through-hole aligned with the discharge opening 502. Further, the valve element 503 includes a rotatable plate 503-*c* interposed between the first and second stationary plates 503-*b* and 503-*d*, the rotatable plate 503-*c* also has a through-hole. It should be noted that the rotatable plate 503-*c* can rotate along the common axis of the valve element 503 relative to the first and second stationary plates 503-*b* and 503-*d*, and it switches between an alignment with the through-holes of the first and second stationary plates 503-*b* and 503-*d* and a misalignment with the through-holes of the first and second stationary plates 503-*b* and 503-*d* during rotation. For example, the alignment of the through-hole of the rotatable plate 503-*c* with the through-holes of the first and second stationary plates 503-*b* and 503-*d* controls the open state of the valve element 503, which corresponds to the charge mode 500-B in FIG. 5B, while the misalignment of the through-hole of the rotatable plate 503-*c* with the through-holes of the first and second stationary plates 503-*b* and 503-*d* controls the closed state of the valve element 503, which corresponds to the non-charge mode 500-A in FIG. 5A.

Optionally, the valve element 503 further comprises a sealing plate 503-*a* interposed between the external bottom surface of the wastewater tank 501 and the first stationary plate 503-*b*, which also has a through-hole aligned with the discharge opening 502.

Specifically, in the embodiment of the present disclosure, the wastewater tank 501, which is used to evaporate wastewater to produce steam, can be implemented as an aluminum evaporation dish. Given that the surface of the aluminum evaporation dish may be relatively rough with some pits, direct contact with the stationary plate 503-*b* of the valve element 503 might result in poor sealing. To address this, the sealing plate 503-*a* can be implemented as a layer of rubber material to achieve an interference fit sealing.

Additionally, the rotatable and stationary plates 503-*b* through 503-*d* can be made of smooth-surfaced materials, allowing for a minimal gap that effectively prevents dust intrusion, thereby avoiding wear on the plates due to dust particles that could compromise the sealing performance. Furthermore, the stationary plates 503-*b* and 503-*d* are selected to have hydrophobic properties, coupled with its strength properties, which further prevents seepage of wastewater from the evaporation dish into the body of the valve element 503. Additionally, between the different layers of the valve element 503, a hydrophobic lubricant is applied, leveraging the surface tension of the lubricant to provide a waterproof seal.

Consequently, a through-hole is created at the edge of each of these four circular plates of the valve element 503. When it is not needed to uncover the discharge opening 502 of the wastewater tank, the through-hole of the rotatable plate 503-*c* remains misaligned with the through-holes of the remaining plates of the valve element 503 (as shown in FIG. 5A), covering the discharge opening 502. On the other hand, when it is necessary to uncover the discharge opening 502, a motor drives the rotation of the rotatable plate 503-*c* (for example, in a counterclockwise direction), and the motor stops when the through-holes of the four plates of the valve element 503 align (as shown in FIG. 5B), uncovering the discharge opening 502. To cover the discharge opening again, the motor may drive the rotation of the rotatable plate 503-*c* in the opposite direction (for example, in a clockwise direction). With the aid of the motor driving, the state of alignment for the through-holes of the four plates can be switched between a misaligned state and an aligned state, allowing the control of the closed and open states of the valve element.

It is understood that the above described control methods and rotation directions of the motor and the rotatable plate are provided as examples, and other suitable control methods may be employed, as long as the alignment state of the through-holes of the four plates can be switched by the actuation of the motor. The present disclosure does not limit the specific mode of operation and direction of the rotation.

In this manner, the issue of damage to the valve element in solid waste discharge scenarios is resolved. By adopting the four-layer flat valve structure as described, there will be no accumulation of solid waste on the valve element during the switching between open and closed states, which would otherwise wear down the components, thereby reducing their scaling performance or lifespan. This improved valve design of the present disclosure ensures a durable and reliable sealing mechanism suitable for environments involving the handling of solid waste generated from distillation of wastewater for water recycling at docking stations, and increase the lifespan of the valve elements.

Figure 5C:
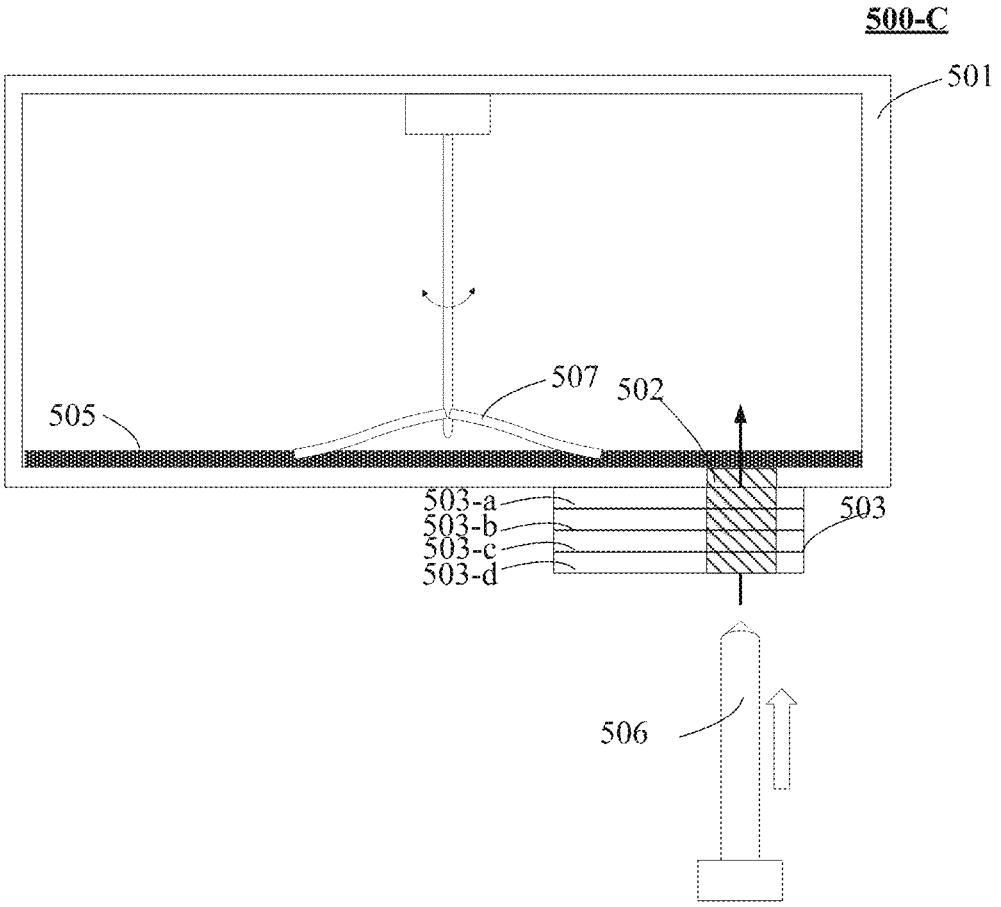
FIGS. 5C-5D show exemplary schematic diagrams of different positions of the discharge opening, and different mounting positions and orientations of the valve element and telescopic mechanism according to embodiments of the present disclosure.
Figure 5D:
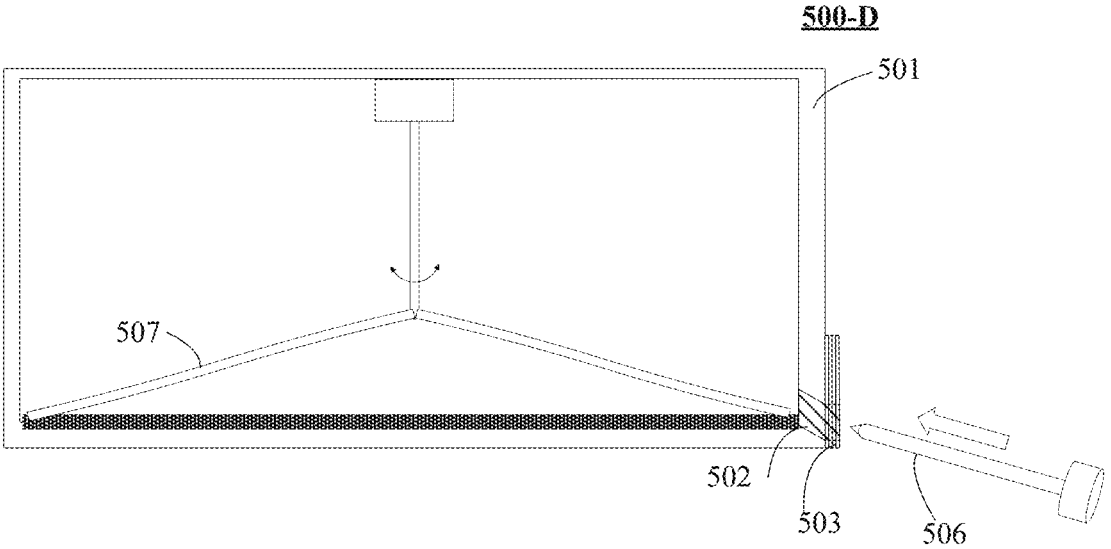

FIGS. 5C-5D show exemplary schematic diagrams of different positions of the discharge opening, and different mounting positions and orientations of the valve element and telescopic mechanism according to embodiments of the present disclosure.

As mentioned above, various mounting positions and actuation directions of the mechanical opening/closing device (e.g., the valve element) and/or the telescopic device (e.g., the telescopic mechanism) are possible, as long as the cooperation of the two devices may allow the telescopic rod to be guided through the opening by extending or retracting its length to penetrate the dirt. For example, the discharge opening of the wastewater tank can be located on the external bottom surface of the wastewater tank (such as those depicted in FIGS. 2-5C), and it can also be located on the bottom haft of the external sidewall surface of the wastewater tank (such as that depicted in FIG. 5D), as long as the discharge opening is located at the bottom half of the wastewater tank for discharging solidified waste. Accordingly, the valve element can also be mounted at various positions to match the location of the discharge opening. In addition, the telescopic mechanism can be not only mounted above the wastewater tank (also referred to as the evaporation dish) but can also be mounted below or around it, and the telescopic mechanism can be mounted inside or outside the wastewater tank, as long as that the telescopic mechanism can operate to switch to its extended state to break through the dried waste after the evaporation is completed. By utilizing the centrifugal force generated by the rotating blades stirring the dirt, it is possible to achieve the discharge of waste by gravity based on various combinations of the mounting positions and actuation directions of the valve element and/or the telescopic mechanism.

FIG. 5C illustrates the waste discharge device in a charge mode 500-C, for which the dry debris is discharged. In this embodiment, the valve element, the telescopic mechanism and the waste crushing mechanism are identical to the corresponding components depicted in FIG. 5B, and details for the components are omitted. The distinction between FIG. 5B and FIG. 5C lies in the mounting position and actuation direction of the telescopic mechanism. Herein, the telescopic mechanism 506 is mounted outside the wastewater tank 501, and moves upwards to switch to its extended position by extending its length to break through the dried waste while the valve element 503 is in the open state.

In FIG. 5C, preferably, a protective or sealing device (such as a protective film) can be installed or formed above the telescopic mechanism 506 to prevent debris falling by gravity from landing on the telescopic mechanism 506, causing wear, contamination or other damages to mechanical parts of the telescopic mechanism 506.

FIG. 5D illustrates the waste discharge device in a charge mode 500-D, for which the dry debris is discharged. In this embodiment, the valve element, the telescopic mechanism and the waste crushing mechanism are identical to the corresponding components depicted in FIG. 5B and FIG. 5C, and details for the components are omitted. The distinction between FIG. 5D and FIGS. 5B-5C also lies in the mounting position and actuation direction of the telescopic mechanism. Herein, the telescopic mechanism 506 is mounted outside the wastewater tank 501, and but does not move in a vertical direction to break through the dried waste. For example, the telescopic mechanism 506 moves in an obliquely upward direction to switch to its extended position by extending its length, to break through the solidified waste formed at the discharge opening (located on the bottom part of the sidewall of the wastewater tank as depicted) of the wastewater tank while the valve element 503 is in the open state.

In accordance with the present disclosure, the valve element and the telescopic mechanism are designed with versatility in their positioning and orientation to accommodate various operational requirements, which offers multiple placement and actuation options that enhance the efficiency of the waste discharge process.

Figure 6:
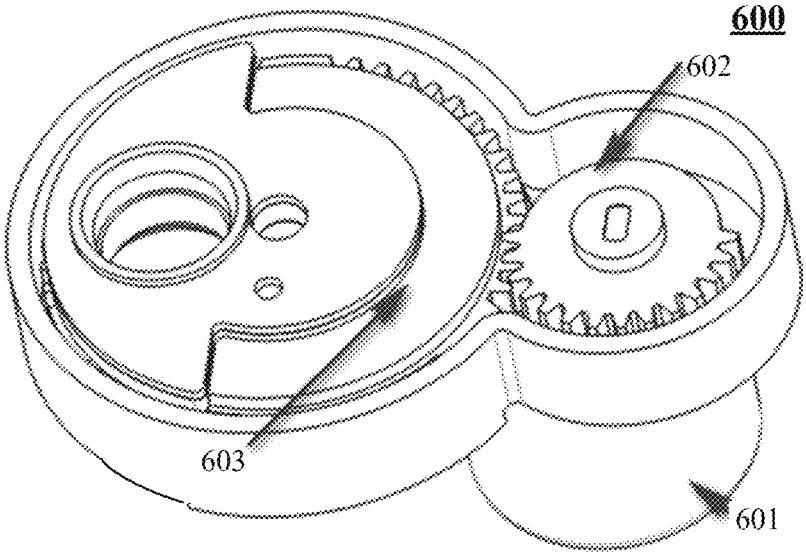
FIG. 6 shows an exemplary schematic diagram of an actuating mechanism of a valve element according to an embodiment of the present disclosure.

FIG. 6 shows an exemplary schematic diagram of an actuating mechanism of a valve element according to an embodiment of the present disclosure.

As depicted, the valve element 600 comprises a second actuator, which serves to provide the necessary rotational force for the rotatable plate, for example, to drive the rotatable plate rotate relative to the stationary plates, as described in FIGS. 5A and 5B. As depicted in FIG. 6, the second actuator includes a second motor 601 and a second transmission mechanism 602 that is mechanically connected to the second motor 601. The second transmission mechanism 602 may be implemented using a gear drive and other transmission mechanism, and can be configured to drive the rotational movement of the rotatable plate 603 in relation to the stationary plates to control the open and closed states thereof.

Furthermore, the valve element 600 also includes a position sensor (not illustrated) that is designed to detect the alignment of the through-hole of the rotatable plate with the through-holes of the first and second stationary plates. Accordingly, the second motor 601 is controlled based on the outcome of this detection, as previously described in combination with FIGS. 5A and 5B. For instance, the detection principle may involve embedding magnets in the gear mechanism and utilizing a Hall sensor for detecting whether all the through-holes align with each other for controlling the motor.

Figure 7:
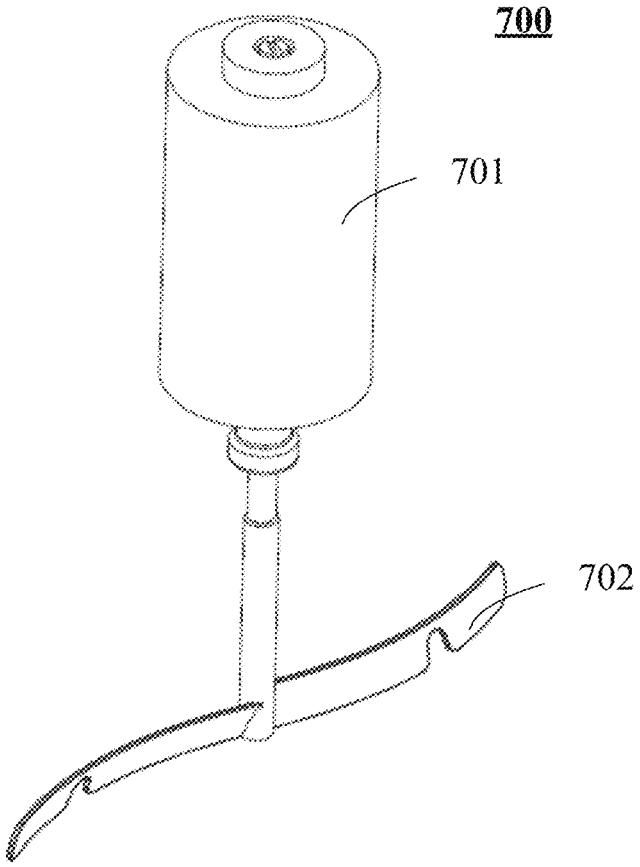
FIG. 7 shows an exemplary schematic diagram of a waste crushing mechanism according to an embodiment of the present disclosure.

FIG. 7 shows an exemplary schematic diagram of a waste crushing mechanism according to an embodiment of the present disclosure.

As depicted, the waste discharge device also includes a waste crushing mechanism 700 mounted inside the wastewater tank. The waste crushing mechanism 700 is similar to the corresponding components depicted in FIG. 2 through FIG. 5B.

According to embodiments of the present disclosure, the waste crushing mechanism 700 comprises a third motor 701 that is configured to provide the rotational torque necessary for the operation of the mechanism, for crushing the waste into smaller pieces, fine particles or powder. The waste crushing mechanism 700 further comprises a set of blades configured to be driven by the rotational force provided by the third motor 701, to scrape off the solidified waste formed on the internal bottom surface of the wastewater tank.

In an example, a current detection mechanism is incorporated into a motor drive circuit. If there is stubborn dirt that gets stuck and causes the blades to jam, which may result in an increase in the current flowing through the motor. In such cases, this surge in current can be detected and as a response, the motor is driven in reverse for a short distance and then accelerated again to break through the obstruction. This approach ensures that the motor can handle tough debris without causing damage or requiring manual intervention.

The designed structure ensures that the solidified waste, which is a byproduct of the wastewater distillation process, is effectively crushed into smaller pieces and discharged through the discharge opening of the wastewater tank by way of gravity feed. In an example, the blades are angled at a predetermined angle relative to the bottom surface of the wastewater tank. This angle is selected to ensure that the blades effectively removes the solid waste from the bottom of the wastewater tank, facilitating the waste discharge process.

With reference back to FIG. 1, the docking station 100, which incorporates the above-described waste discharge device, is described in further detail.

According to embodiments of the present disclosure, the docking station for a cleaning robot 10, comprise a clean water tank configured to store a supply of clean water. In addition, the docking station can further comprise a wastewater tank (such as the wastewater tank 102 of FIG. 1), which is configured to collect wastewater generated from washing one or more mopping pads of the cleaning robot 10 to be distilled for generating the clean water. As mentioned, the wastewater tank has a discharge opening at its bottom for discharging solidified waste generated from distillation of the wastewater.

According to embodiments of the present disclosure, the docking station and the cleaning robot 10 may be provided as a complete package in a form of a cleaning system. In the cleaning system, the cleaning robot 10, for example, the cleaning robot 10 as shown in FIG. 1, may perform a cleaning task for the users, such as sweeping and/or mopping tasks on various floor surfaces. Accordingly, the docking station may provide docking functions for the cleaning robot 10, such as recharging a battery of the cleaning robot 10, collecting dry debris from the cleaning robot 10 into a dustbin of the docking station and performing a cleaning process for the mopping pads of the cleaning robot 10. Details of the structure of the cleaning robot 10 is known to those skilled in the art and omitted herein.

As mentioned above in combination with FIGS. 2-7, the docking station can further comprise a waste discharge device having a valve element and a mechanism that can be actuated. The valve element is mounted at a position corresponding to the discharge opening, and it is operable in an open state for uncovering the discharge opening or a closed state for covering the discharge opening. The mechanism can be configured to be actuated while the valve element is in the open state to break through solidified waste formed at the discharge opening. For example, the mechanism can be implemented as a telescopic mechanism movable between a retracted position and an extended position relative to the discharge opening. For example, the valve element can be mounted on an external bottom surface of the wastewater tank, and the telescopic mechanism can be disposed above the discharge opening inside the wastewater tank or disposed below the discharge opening outside the wastewater tank, and movable vertically between the retracted position and the extended position. Accordingly, the telescopic mechanism can be controlled to move from the retracted position to the extended position while the valve element is in the open state to break through the solidified waste formed at the discharge opening of the wastewater tank.

According to an embodiment of the present disclosure, the docking station further comprises a heater mounted on an external side wall of the wastewater tank and configured to heat the collected wastewater for generating the clean water to be stored in the clean water tank. For instance, the heater may take the form of a heating strip 11 in FIG. 1 or any other suitable heating device. Furthermore, the docking station may include a fan mechanism installed inside the wastewater tank, which enhances air circulation and accelerates the evaporation process of the wastewater, thereby improving the efficiency of clean water production.

In this embodiment, the docking station further comprises a temperature sensor configured to detect a temperature of the wastewater heated in the wastewater tank. In this case, the heater is controlled based on the detected temperature to maintain the temperature of the heated wastewater at a predetermined temperature below a boiling point, for example, using a Proportion Integration Differentiation (PID) algorithm. For example, the heater can be controlled in various ways, such as by controlling the heating power of the heater, or by controlling the connection or disconnection with its power supply, thereby enabling precise temperature control of the wastewater. This ensures that the wastewater undergoes evaporation at a temperature that prevents boiling, thereby effectively avoiding the spattering of solid particles that can result from boiling (which may otherwise pass through the pipe of the wastewater tank for expelling hot steam and cause contamination to the purified water) and avoiding the generation of unpleasant odors that can result from burning or charring.

According to another embodiment of the present disclosure, the docking station further comprises the clean water generation device (such as the clean water generation device 101 of FIG. 1) configured to generate the clean water from the water vapor using one or both of a condensation mechanism and a moisture absorption mechanism.

In an example of this embodiment, the condensation mechanism comprises one or more of a compressor cooling mechanism, a semiconductor cooling mechanism, an air-cooling mechanism, and a liquid cooling mechanism among other examples, such that the condensed liquid water can be collected in the clean water tank. In another example of this embodiment, the moisture absorption mechanism comprises hygroscopic materials for absorbing the water vapor and a heater for heating the hygroscopic materials for generating liquid water, which can be collected in the clean water tank.

Understandably, the process of generating clean water by the clean water generation device 101 through condensation may result in the formation of water droplets. To optimize this process, it is preferable to have a tray or basin in place to collect these purified water droplets initially. This tray serves as an intermediary container where the condensate is first gathered. Once the water in the tray accumulates to a certain level, it can then be pumped into the clean water tank. This approach helps to avoid the frequent and unnecessary activation of the pump, which could lead to undesirable noise.

It can be understood that the specific water production approach can be selected based on a variety of factors, such as the climatic characteristics of different regions. For instance, in humid and warm regions like Southeast Asia, semiconductor cooling mechanism with lower water production capacity could be chosen, which can reduce costs while still meeting the water production needs. However, for areas with low humidity like California in the United States, compressor cooling should be selected to ensure a satisfactory user experience. It should be noted that other factors can be considered to make a proper selection.

According to other embodiments of the present disclosure, either alone or in combination with the above-described embodiments, the telescopic mechanism, e.g., in FIG. 2, comprises: an actuator comprising a first motor and a transmission mechanism mechanically connected to the first motor, the transmission mechanism is configured to translate a rotational movement of the first motor into a linear movement of the actuator; and a push-pull rod mechanically connected to the actuator and driven by the linear movement of the actuator to move vertically between the retracted position and the extended position.

According to other embodiments of the present disclosure, either alone or in combination with the above-described embodiments, the telescopic mechanism, e.g., in FIG. 3, comprises: an electromagnet for generating a magnetic attraction force when energized; a spring element for generating an elastic force when compressed; and a magnetic push-pull rod mechanically connected to the spring element and driven by the magnetic attraction force of the electromagnet or the elastic force of the spring element to move vertically between the retracted position and the extended position.

According to other embodiments of the present disclosure, either alone or in combination with the above-described embodiments, the valve element, e.g., in FIGS. 5A-5D, comprises: a first stationary plate and a second stationary plate, each of the first and second stationary plates has a through-hole aligned with the discharge opening of the wastewater tank; a rotatable plate interposed between the first and second stationary plates, the rotatable plate having a through-hole, wherein an alignment of the through-hole of the rotatable plate with the through-holes of the first and second stationary plates controls the open state of the valve element, and a misalignment of the through-hole of the rotatable plate with the through-holes of the first and second stationary plates controls the closed state of the valve element. In an example, the rotatable plate is made of ceramic, and the first and second stationary plates are made of Polytetrafluoroethylene. Additionally, the valve element, e.g., in FIGS. 5A-5D, further comprises a sealing plate interposed between the external bottom surface of the wastewater tank and the first stationary plate, the sealing plate has a through-hole aligned with the discharge opening of the wastewater tank.

According to other embodiments of the present disclosure, either alone or in combination with the above-described embodiments, the valve element, e.g., in FIG. 6, further comprises: a second actuator comprising a second motor and a second transmission mechanism mechanically connected to the second motor, and configured for driving a rotational movement of the rotatable plate relative to the first and second stationary plates; and a position sensor configured to detect whether the through-hole of the rotatable plate aligns with the through-holes of the first and second stationary plates. In an example, the second motor is controlled based on a result of the detecting.

According to other embodiments of the present disclosure, either alone or in combination with the above-described embodiments, the waste discharge device further comprises a waste crushing mechanism, e.g., in FIG. 7, mounted inside the wastewater tank. The waste crushing mechanism comprises: a third motor configured to provide a rotation torque; and a set of blades configured to be driven by the rotation torque of the third motor to scrape off the solidified waste formed on an internal bottom surface of the wastewater tank, such that the solidified waste generated from the distillation of the wastewater is discharged through the discharge opening of the wastewater tank by gravity feed.

Figure 8:
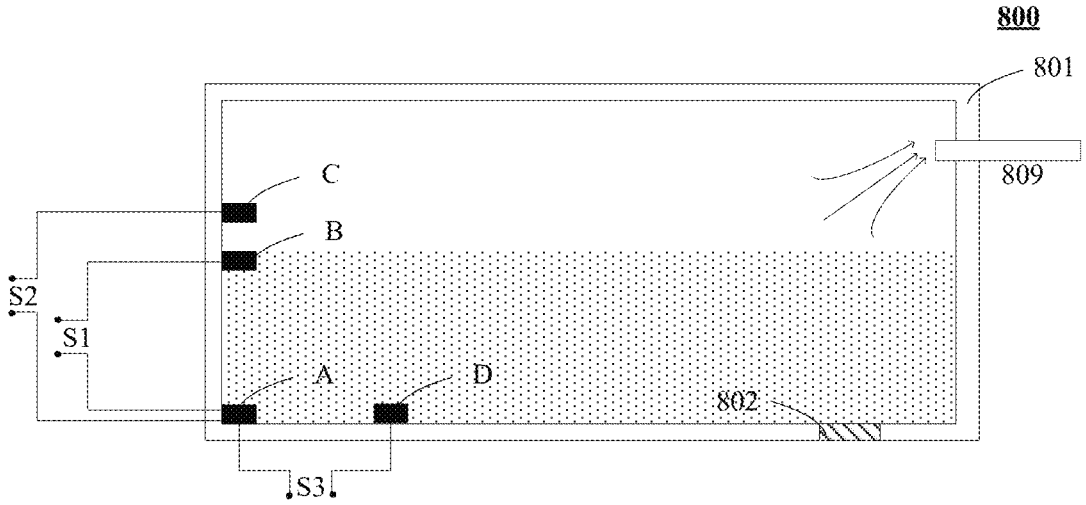
FIG. 8 shows an exemplary schematic diagram of metal contacts in the wastewater tank for water level detection according to an embodiment of the present disclosure.

FIG. 8 shows an exemplary schematic diagram of metal contacts in the wastewater tank for water level detection according to an embodiment of the present disclosure.

As illustrated in FIG. 8, the wastewater tank 801 is equipped with a discharge opening 802 at the bottom and a pipe 809 on the side wall for expelling hot steam generated during the evaporation process, e.g., to the clean water generation device 101. In this embodiment, the detection of water level is achieved by monitoring the conductivity state of paired metal contacts (which are also referred to as metal electrodes or probes in the present disclosure), which facilitates the process of wastewater treatment in the wastewater tank. As shown, the wastewater tank 801 is furnished with multiple metal contacts, labeled A to D, to perform various functions related to water level detection.

In a first example, metal contacts A and B are utilized to detect the upper limit of the water level, thereby controlling the collection process of wastewater within the tank. As depicted, a first metal contact A is mounted on the internal bottom surface of the wastewater tank 801, and a second metal contact B is mounted on the internal side wall of the wastewater tank 801 at a first height corresponding to a water level upper limit. Accordingly, the collection of the wastewater in the wastewater tank 801 can be controlled based on a first conductive state S1 between the first metal contact A and the second metal contact B.

For instance, when the water level has not reached the first height where the second metal contact B is located, indicating that metal contacts A and B are not conductive (or not short-circuited), it suggests that the wastewater pumped into the wastewater tank has not reached its treatment capacity. Consequently, the docking station can continue to pump wastewater into the wastewater tank. In contrast, when the water level rises to the height of the second metal contact B, the conductivity of the wastewater will cause metal contacts A and B to become conductive (short-circuited), signaling to halt the pumping of wastewater.

This approach of detecting the upper limit of the water level is a significant advancement over traditional methods that rely on magnetic floats and magnetic sensing devices, and offers a more straightforward, efficient, and precise approach to water level monitoring, ensuring optimal operation of the wastewater treatment process.

In a second example, the first metal contact A and a third metal contact C can be used for detecting the boiling of wastewater, thereby controlling the heating process inside the wastewater tank, which can involve adjusting the heating power of the heater or managing the connection and disconnection of the heater's power supply. As depicted, the third metal contact C is mounted on the internal side wall of the wastewater tank 801 at a second height, and the second height is higher than the first height and corresponds to the boiling point water level. Accordingly, the heater (for instance, its heating power or its connection status to the power source) can be controlled based on a second conductive state S2 between the first metal contact A and the third metal contact C. This control mechanism is designed to maintain the wastewater at a predetermined temperature below the boiling point.

For instance, it can be understood that the water surface is calm before boiling, but when boiling occurs, it may become turbulent and potentially rise above the upper limit of the water level. Therefore, when the turbulent boiling of the wastewater causes the water level to reach the second height where the third metal contact C is located, resulting in conduction (or short-circuit) between metal contacts A and C, it indicates that the wastewater has started to boil. At this point, it is necessary to reduce the power of the heater or temporarily disconnect its power supply to keep the water temperature below boiling.

Hence, complementing the temperature control approach as mentioned earlier through a PID algorithm, even if the PID algorithm fails, reliable boiling detection can still be achieved through the detection of the conductive state of the metal contacts. This approach effectively prevents the spattering of solid particles that can occur due to boiling and avoids the generation of unpleasant odors that can result from burning or charring.

In a third example, the first metal contact A and a fourth metal contact D can be used to detect if the wastewater is about to be dried out, thereby controlling the heating process inside the wastewater tank, which may also involve adjusting the heating power of the heater or managing the supply or disconnection of the heater's power source. As shown, the fourth metal contact D is also mounted on the internal bottom surface of the wastewater tank, positioned at approximately the same height as metal contact A. Accordingly, the heater is controlled based on a third conductive state S3 between the first metal contact A and the fourth metal contact D. The objective is to prevent the wastewater from completely drying out. Preferably, the power supply to the heater is immediately disconnected to cease heating.

For instance, it can be understood that while there is still wastewater being evaporated, both metal contacts A and D are submerged within the water, thus they are in a conductive state (short-circuited). However, once the wastewater has fully evaporated, the conductive state between them will cease. Consequently, when metal contacts A and D are no longer in a conductive state, it is imperative to immediately disconnect the power supply to prevent any further heating of the wastewater tank, which could otherwise lead to undesirable odors, product damage, or even potential hazards such as fires. This approach ensures that the wastewater is heated efficiently and safely, avoiding the risks associated with over-heating and promoting a more reliable operation of the cleaning robot's docking station.

It should be noted that the number of metal contacts and their respective positions as illustrated in the above examples are provided as examples, a greater number of metal contacts installed at various locations inside the wastewater tank can be used, as long as these metal contacts are arranged in pairs to facilitate water level detection. Additionally, a variety of methods for detecting the conductivity status between two contacts can be used, for example, by measuring electrical current or resistance, the present disclosure does not impose limitations on the specific techniques used for such detection.

Figure 9:
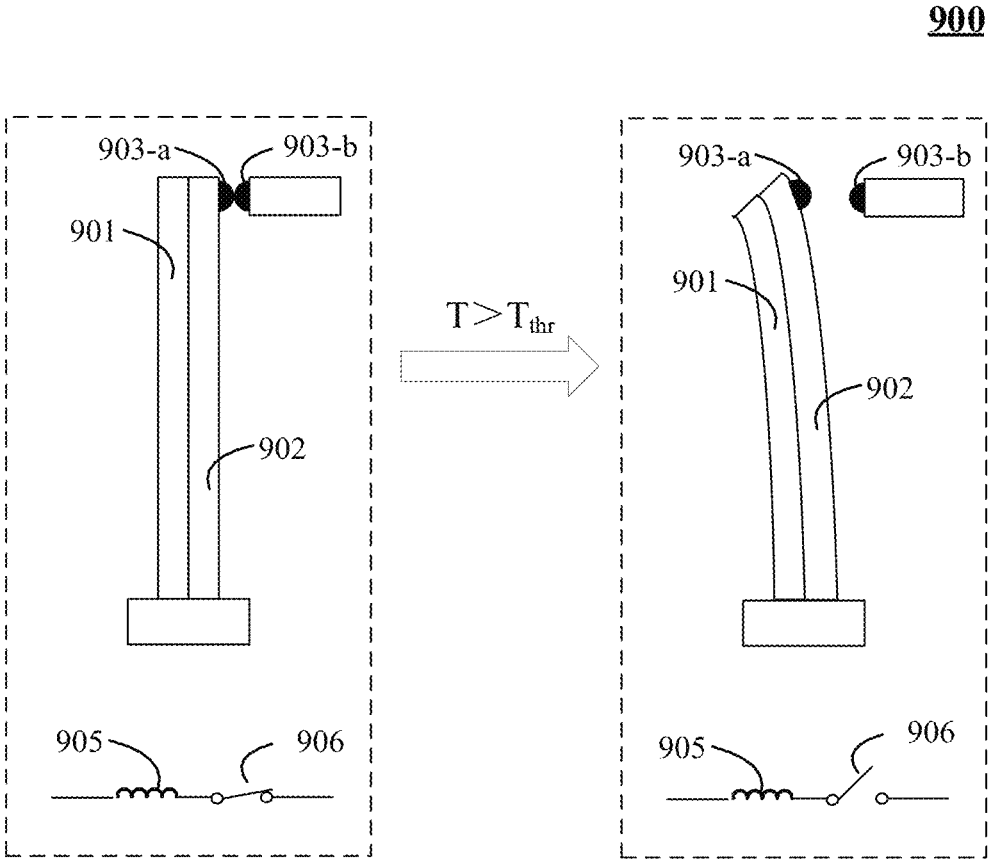
FIG. 9 shows an exemplary schematic diagram of a bimetallic switch for controlling the heating process according to an embodiment of the present disclosure.

FIG. 9 shows an exemplary schematic diagram of a bimetallic switch for controlling the heating process according to an embodiment of the present disclosure.

In this embodiment, a bimetallic switch is mounted on the external side wall of the wastewater tank, and it comprises a first metal plate and a second metal plate, each of the plates has a different temperature coefficient. Accordingly, the heater can be controlled with the aid of the bimetallic switch in response to different thermal deformations of the first metal plate and the second metal plate.

For example, the operation of the bimetallic switch 900 is depicted in the two dashed-line blocks of FIG. 9, illustrating the ON state (the left part of FIG. 9) and the OFF state (the right part of FIG. 9B). The working principle of the bimetallic switch is based on the fabrication of two metal plates with different temperature coefficients, such as the thermal expansion coefficients. As the temperature rises, the differential in deformation between the two metal plates increases. Once a certain temperature threshold is exceeded, the metal plates deflect, causing electrical contact points to separate and thereby interrupting power supply.

As shown in the left-hand dashed-line block of FIG. 9, the bimetallic switch has a first metal plate 901 (the passive layer) and a second metal plate 902 (the active layer). At room temperature and without deformation, the contact points 903-*a* and 903-*b* remain in contact. In this state, which corresponds to the closed position of switch 906, the heater 905 (which may be a heating wire encircling the exterior of the wastewater tank) is connected to its power source (not shown), initiating the heating process.

However, as depicted in the right-hand dashed-line block of FIG. 9, when the temperature of the metal plates increases due to the heating by the heater 905 (for example, when the temperature exceeds a threshold $T_{thr}$), the second metal plate 902, being the active layer, expands more than the first metal plate 901 as the passive layer. This causes the metal plates of the bimetallic switch to bend towards the left, resulting in the separation of contact points 903-*a* and 903-*b*. In this state, which corresponds to the open position of switch 906, the heater 905 is disconnected from its power source, ceasing the heating process.

In this example, the bimetallic switch provides an additional protective mechanism against drying out, further ensuring the reliable avoidance of unpleasant odors and dangers associated with burning or charring. This feature enhances the safety and reliability of the wastewater treatment process in the docking station of the cleaning robot 10. It should be noted that various types of metal plates can be used as long as they have different temperature coefficients, the present disclosure does not limit the materials used.

Figure 10:
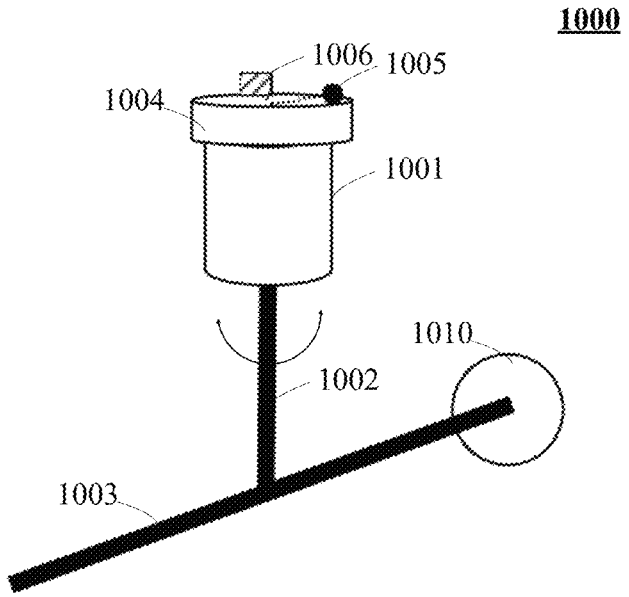
FIG. 10 shows an exemplary schematic diagram of a waste crushing mechanism according to another embodiment of the present disclosure.
Figure 10:
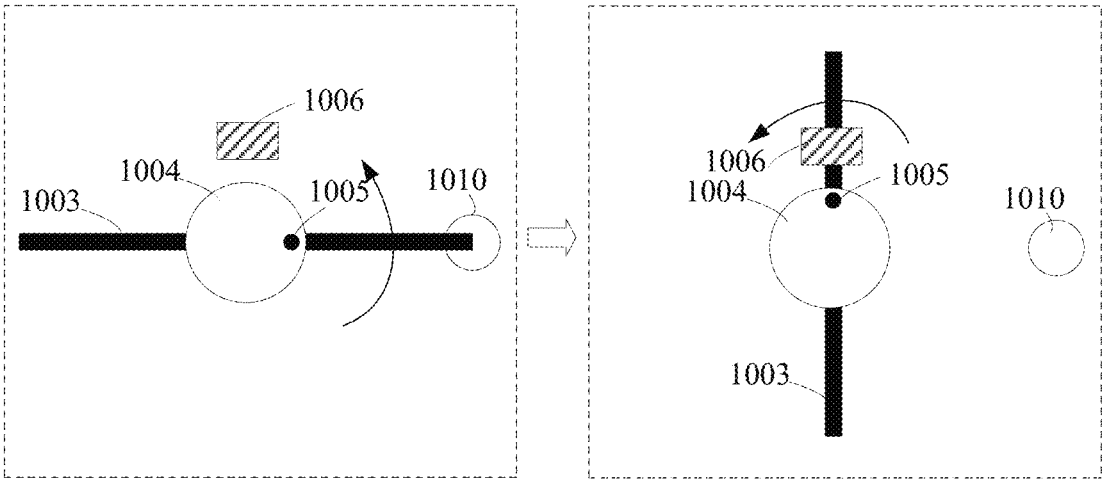

FIG. 10 shows an exemplary schematic diagram of a waste crushing mechanism according to another embodiment of the present disclosure.

The inventors have recognized a potential issue that arises when the length of the rotating blades of the waste crushing mechanism is extended across the entire bottom surface of the wastewater tank to effectively scrape and remove dried waste. For example, if the blades stop rotating directly over the discharge opening of the wastewater tank, it could lead to interference with the telescopic mechanism when the telescopic mechanism moves downward to its extended position to break through solidified waste. This could potentially damage the blades or the telescopic rod during the impact process for the solidified waste.

To address this, a blade positioning mechanism is proposed to prevent the blades from stopping over the discharge opening, ensuring that the telescopic mechanism can move downward without colliding with the blades, which is described hereinafter in FIG. 10. It should be noted that the waste crushing mechanism of FIG. 10 is substantially similar to that mentioned in FIG. 7, the main difference lies in the introduction of a rotating magnet and a magnetic detection device to control the resting position of the blades.

According to embodiments of the present disclosure, the waste crushing mechanism includes a rotating plate mounted on a first end of a rotating shaft of the third motor (e.g., the third motor as described in FIG. 7), wherein a magnet is mounted on an edge of the rotating plate and rotates together with the set of blades mounted on a second end of the rotating shaft opposite to the first end. In addition, the waste crushing mechanism further includes a magnetic sensing element mounted on an internal side wall of the wastewater tank at a height corresponding to the rotating plate and within a threshold distance to the rotating plate. Accordingly, a position of the set of blades is controlled based on a result of detecting the magnet by the magnetic sensing element during rotation of the set of blades.

As depicted in FIG. 10, the waste crushing mechanism 1000 includes a motor 1001, which provides the power needed for waste crushing, and a set of blades 1003 that crush the waste during its rotation for discharge of the dry debris by gravity. The motor 1001 also has a rotating shaft 1002, with one end fitted with a rotating plate 1004 and the other end with the blades 1003. A magnet 1005 is mounted on the edge of the rotating plate 1004 and rotates together with the blades 1003, indicating the position where the blades will rest. Consequently, the location where the magnet stops rotating serves as an indicator of the blades' resting position. For example, the magnet 1005 is located such that a line drawn from the magnet to the pivot point of the motor's rotational axis is parallel to a lengthwise direction of the blades, as shown in FIG. 10.

Additionally, a magnetic sensing element 1006, such as a Hall sensor, is mounted on the internal side wall of the wastewater tank at a height corresponding to the rotating plate, and detects whether the magnet 1005 approaches the magnetic sensing element 1006 during the rotation of the blades 1003. For instance, the magnetic sensing element 1006 is positioned such that a line drawn from the magnetic sensing element to the pivot point of the motor's rotational axis is perpendicular to the line drawn from the discharge opening 1010 to the pivot point of the motor's rotational axis. Accordingly, the magnetic sensing element 1006 triggers (e.g., successfully detects an existence of a magnet nearby) when the magnet 1005 approaches the sensor 1006, which indicates that the rotating blades are away from the discharge opening 1010, preventing interference between the telescopic mechanism and the blades and avoiding damage to critical components.

For example, as shown in the left-hand dashed-line block of FIG. 10, the detection of magnet 1005 being away from the magnetic sensing element 1006 indicates a possibility that the blades are directly above the discharge opening 1010. At this point, the motor 1001, through the rotating shaft 1002, continues to drive the blades 103 to rotate. In contrast, as shown in the right-hand dashed-line block of FIG. 10, when the magnet 1005 is detected to be close to the magnetic sensing element 1006, it indicates that the blades are not positioned above the opening 1010. Consequently, the motor 1001 can halt, ensuring that the blades will not rest directly above the opening 1010.

It should be noted that the specific locations of the magnet and the magnetic sensing element described in the example are illustrative. The actual installation positions can vary as long as they can effectively determine whether the blades are above the discharge opening. The present disclosure does not restrict the specific installation positions.

Figure 11:
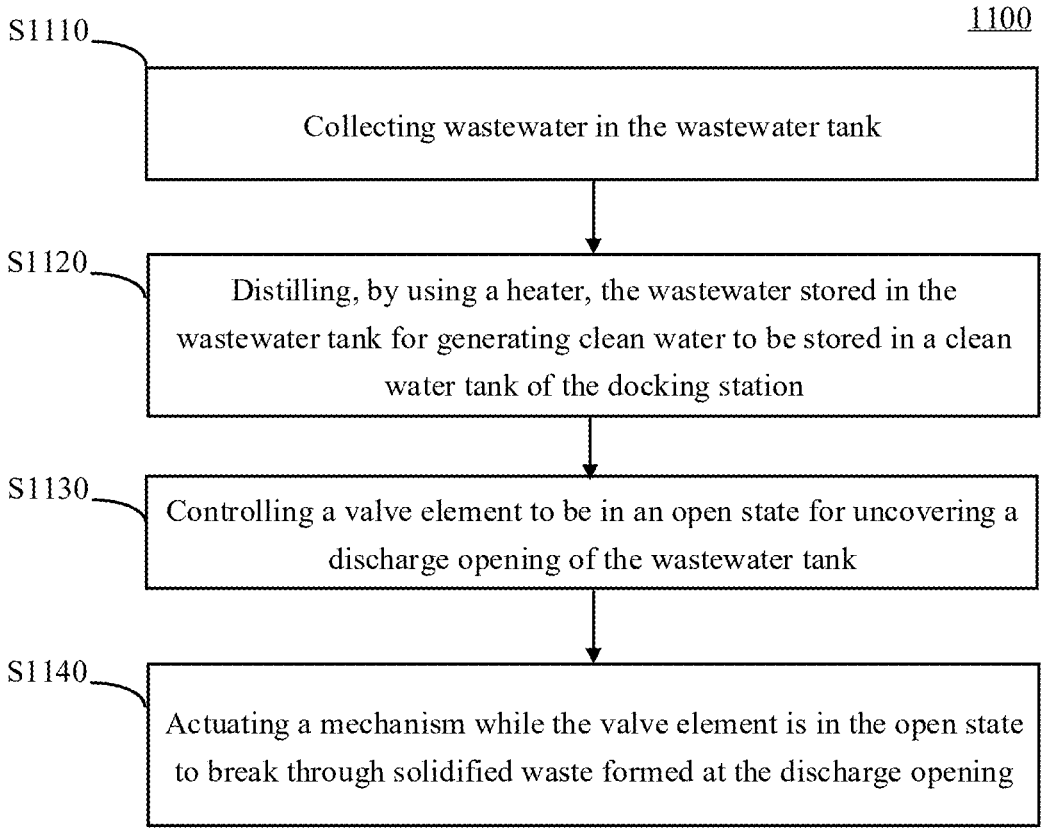
FIG. 11 shows a flowchart of a computer-implemented method of operating a docking station of a cleaning robot according to an embodiment of the present disclosure.

FIG. 11 shows a flowchart of a computer-implemented method of operating a docking station of a cleaning robot 10 according to an embodiment of the present disclosure.

The method may be implemented in the docking station as depicted in FIG. 1 and the detailed description of method 1100 can refer to the content described in the above with respect to FIGS. 1-10. For example, method 1100 can be executed in the structure described with respect to FIGS. 1-10 and according to the control operations on the components of the docking station of the cleaning robot 10 involved in the processes of wastewater distillation, solidified waste discharge and clean water generation among other processes as described with respect to FIGS. 1-10. In addition, each step of method 1100 can be performed by one or more processing units, such as central processing unit (CPU) of the docking station.

With reference to FIG. 11, method 1100 comprises steps S1110-S1140.

At step S1110, method 1100 comprises collecting wastewater in the wastewater tank. Specifically, the wastewater was generated from washing one or more mopping pads of the cleaning robot 10. According to an example, the wastewater can be collected through various suitable methods. For instance, a vacuum pump or a sump pump can be utilized to extract the wastewater generated from cleaning the mopping pads into the wastewater tank. It is understood that alternative appropriate methods can be employed for collecting wastewater into the wastewater tank for subsequent distillation and purification treatment.

Additionally, a wastewater transfer tank can be installed alongside the wastewater tank to temporarily hold the wastewater before it is further transferred to the wastewater tank, also referred to as an evaporation dish, for heating and evaporation. It should be noted that the wastewater transfer tank can be selectively used for wastewater collection. By eliminating the wastewater transfer tank, the need for certain peripheral auxiliary devices can be avoided, which helps to reduce the overall size and cost of the docking station. Conversely, incorporating the additional transfer tank can facilitate the process by reducing the difficulty of creating a negative pressure in the wastewater tank or the evaporation dish.

At step S1120, method 1100 comprises distilling, by using a heater, the wastewater stored in the wastewater tank for generating clean water to be stored in a clean water tank of the docking station. In this step, a temperature of the wastewater heated in the wastewater tank can be detected and a heating power of the heater is controlled to maintain the temperature of the heated wastewater at a predetermined temperature below a boiling point. As a result, the solidified waste will be generated at the bottom of the wastewater tank.

Concurrently with step S1130, a clean water generation device 101 of the docking station can be controlled to generate the clean water from water vapor using one or both of a condensation mechanism and a moisture absorption mechanism. In an example, as described above, the condensation mechanism comprises one or more of a compressor cooling mechanism, a semiconductor cooling mechanism, an air-cooling mechanism, and a liquid cooling mechanism. In another example, as described above, the moisture absorption mechanism comprises hygroscopic materials for absorbing the water vapor and a heater for heating the hygroscopic materials for generating liquid water.

Optionally, during the evaporation of wastewater, the wastewater heated in the wastewater tank can be agitated, for example, using the afore-mentioned rotating blades, to prevent caking and charring, which can produce unpleasant odors.

At step S1130, method 1100 comprises controlling a valve element to be in an open state for uncovering the discharge opening. For example, the valve element, such as those described in FIGS. 2-5D, is mounted at a position corresponding to the discharge opening. Details for the control of the valve element can refer to the descriptions of FIGS. 2-5D, and omitted here.

At step S1140, method 1100 comprises actuating a mechanism while the valve element is in the open state to break through solidified waste formed at the discharge opening. For example, the mechanism can be implemented a telescopic mechanism, and the telescopic mechanism can be actuated by moving the telescopic mechanism from a retracted position to an extended position relative to the discharge opening to break through the solidified waste formed at the discharge opening. For example, the telescopic mechanism, such as those described in FIGS. 2-5D, is disposed at various positions relative to the discharge opening inside or outside the wastewater tank. Details for the control of the telescopic mechanism can refer to the descriptions of FIGS. 2-5D.

According to the joint control of the valve element and telescopic mechanism in steps S1130 and S1140, the discharge opening can be prevented from being blocked by the solidified waste generated from the distillation of wastewater.

In addition, method 1100 comprises scraping off the solidified waste formed on an internal bottom surface of the wastewater tank, such that the solidified waste generated from the distillation of the wastewater is discharged through the discharge opening of the wastewater tank by gravity feed. For example, the solidified waste can be scraped off by using the waste crushing mechanism, such as those described in FIGS. 2-7, into smaller pieces, fine particles or powder and can be easily discharged through the cleared discharge opening.

An exemplary operational procedure for the valve element, telescopic mechanism, and rotating blades is as follows. The valve element at the bottom of the wastewater tank or evaporation dish is switched to its open state, allowing the telescopic mechanism to extend to its extended position to break through the solidified waste accumulated at through-hole of the valve element. The telescopic mechanism then retracts to its retracted position, and the rotating blades (optionally accompanied by dust brushes that rotate with the blades) crushes and sweeps the dry debris towards the cleared discharging opening. The dry debris then falls into the dust collection box through the cleared discharging opening by gravity. This process is repeated several times, for example, 10 times. Subsequently, the valve element is closed, returning to the initial state, and waits for the collection of the next round of wastewater to begin the next cycle of water purification treatment. Thereafter, when the dust collection box is filled with dried debris, the user simply empties it.

In this way, users are spared the trouble of removing the wastewater tank and pouring out the wastewater, as well as manually cleaning and unclogging the discharging opening, reducing the burden of operation and enhancing the user experience. It is understood that the above procedure serves as an example and different control methods can be applied to the docking station to achieve efficient wastewater treatment and solid waste cleanup. The present disclosure is not limited to the specific mode of operation described.

At least based on the above embodiments of the present disclosure, an improved mechanism for handling the wastewater generated from cleaning the mopping pads and for handling the solidified waste generated from the distillation of the wastewater at the docking station to enhance the user experience while recycling water resources. Additionally, the discharge opening of the wastewater tank can be efficiently prevented from being blocked by the solidified waste generated from the distillation of wastewater based on the linked control and coordination of the telescopic mechanism and the valve element of the waste discharge device, without the need to manually check and clear the discharge opening.

Figure 12:
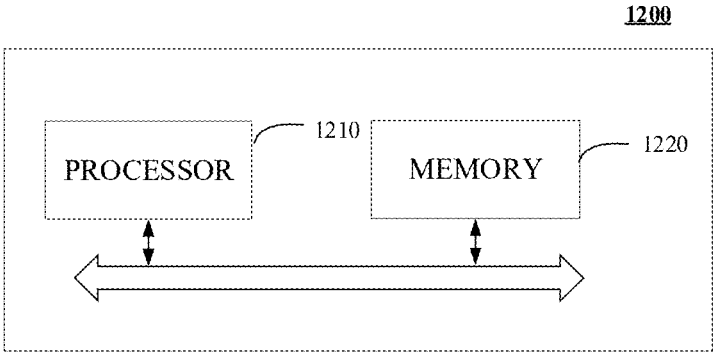
FIG. 12 is an exemplary block diagram illustrating a computing device according to embodiments of the disclosure.

FIG. 12 is an exemplary block diagram illustrating a computing device according to embodiments of the disclosure.

It should be noted that the computing device depicted in FIG. 12 can be used in the docking station to control the operation of the components of the docking station to operate the docking station, for example, to perform method 1100 as described above.

As shown in FIG. 12, the computing device 1200 can comprise processor 1210 and memory 1220. The processor 1210 is communicatively coupled with the memory and configured to perform the methods discussed above.

Examples of the processor 1210 comprise microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout The present disclosure.

The processor 1210 can execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The software may reside on memory 1220.

The memory 1220 may be a non-transitory computer-readable medium. A non-transitory computer-readable medium includes, by way of example, a magnetic storage device (e.g., hard disk, floppy disk, magnetic strip), an optical disk (e.g., a compact disc (CD) or a digital versatile disc (DVD)), a smart card, a flash memory device (e.g., a card, a stick, or a key drive), a random access memory (RAM), a read-only memory (ROM), a programmable ROM (PROM), an erasable PROM (EPROM), an electrically erasable PROM (EEPROM), a register, a removable disk, and any other suitable medium for storing software and/or instructions that may be accessed and read by a computer. The memory 1220 may reside in the processor 1210, external to the processor 1210, or distributed across multiple entities including the processor 1210. The memory 1220 may be embodied in a computer program product. By way of example, a computer program product may include a computer-readable medium in packaging materials. Those skilled in the art will recognize how to implement the described functionality presented throughout the present disclosure depending on the particular application and the overall design constraints imposed on the overall system.

In addition, according to another embodiment of the present disclosure, a computer program product for forwarding data packets for a client device is disclosed. As an example, the computer program product comprises a non-transitory computer readable storage medium having program instructions embodied therewith, and the program instructions are executable by a processor. When executed, the program instructions cause the processor to perform one or more of the above described procedures, and details are omitted herein for conciseness.

The present disclosure may be a system, a method, and/or a computer program product at any possible technical detail level of integration. For example, the system may be a cleaning system including a cleaning robot 10 and docking station for use with the cleaning robot 10. The computer program product may include a computer readable storage medium (or media) having computer readable program instructions thereon for causing a processor to carry out aspects of the present disclosure.

Expression such as "according to", "based on", "dependent on", and so on as used in the disclosure does not mean "according only to", "based only on", or "dependent only on", unless it is explicitly otherwise stated. In other words, such expression generally means "according at least to", "based at least on", or "dependent at least on" in the disclosure.

Any reference in the disclosure to an element using the designation "first", "second" and so forth is not intended to comprehensively limit the number or order of such elements. These expressions can be used in the disclosure as a convenient method for distinguishing two or more units. Thus, a reference to a first unit and a second unit does not imply that only two units can be employed or that the first unit must precede the second unit in some form.

The term "determining" used in the disclosure can include various operations. For example, regarding "determining", calculating, computing, processing, deriving, investigating, looking up (e.g., looking up in tables, databases, or other data structure), ascertaining, and so forth are regarded as "determination". In addition, regarding "determining", receiving (for example, receiving information), transmitting (for example, transmitting information), input, output, accessing (for example, access to data in the memory), and so forth, are also regarded as "determining". In addition, regarding "determining", resolving, selecting, choosing, establishing, comparing, and so forth can also be regarded as "determining". That is, regarding "determining", several actions can be regarded as "determining".

The terms such as "connected", "coupled" or any of their variants used in the disclosure refer to any connection or combination, direct or indirect, between two or more units, which can include the following situations: between two units that are "connected" or "coupled" with each other, there are one or more intermediate units. The coupling or connection between the units can be physical or logical, or can also be a combination of the two. As used in the disclosure, two units can be considered to be electrically connected through the use of one or more wires, cables, and/or printed, and as a number of non-limiting and non-exhaustive examples, and are "connected" or "coupled" with each other through the use of electromagnetic energy with wavelengths in a radio frequency region, the microwave region, and/or in the light (both visible and invisible) region, and so forth.

When used in the disclosure or the claims 'including", "comprising", and variations thereof, these terms are as open-ended as the term "having". Further, the term "or" used in the disclosure or in the claims is not an exclusive-or.

The present disclosure has been described in detail above, but it is obvious to those skilled in the art that the present disclosure is not limited to the embodiments described in the disclosure. The present disclosure can be implemented as a modified and changed form without departing from the spirit and scope of the present disclosure defined by the description of the claims. Therefore, the description in the disclosure is for illustration and does not have any limiting meaning to the present disclosure.

What is claimed is:

1. A waste discharge device for use in a docking station of a cleaning robot, the docking station having a wastewater tank with a discharge opening at its bottom, the waste discharge device comprising:

a valve element mounted at a position corresponding to the discharge opening, the valve element being operable in an open state for uncovering the discharge opening or a closed state for covering the discharge opening; and a solid waste breaking mechanism configured to be actuated while the valve element is in the open state to break through solidified waste generated from distillation of the wastewater and formed at the discharge opening such that the solidified waste generated from distillation of the wastewater is discharged through the discharge opening of the wastewater tank, wherein the solid waste breaking mechanism is a telescopic mechanism movable between a retracted position and an extended position relative to the discharge opening, and the waste discharge device further comprises a processor configured to:

control the valve element to be in the closed state and control the telescopic mechanism to be in the retracted position, such that the solidified waste is not discharged;

control the valve element to be in the open state and actuate the telescopic mechanism from the retracted position to the extended position, such that the solidified waste is discharged, wherein the telescopic mechanism is controlled to be guided through the discharge opening by extending to a full length of the telescopic mechanism at the extended position to penetrate the solidified waste generated from distillation of the wastewater and formed at the discharge opening.

2. The waste discharge device of claim 1, wherein the telescopic mechanism comprises:

a motor actuator comprising a first motor configured to provide a rotational movement, wherein the rotational movement of the first motor is translated into a linear movement of the actuator; and a push-pull rod mechanically connected to the actuator and driven by the linear movement of the actuator to move between the retracted position and the extended position.

3. The waste discharge device of claim 1, wherein the telescopic mechanism comprises:

an electromagnetic actuator configured to provide a magnetic attraction force when being energized or provide an elastic force when being de-energized; and a magnetic push-pull rod mechanically connected to the electromagnetic actuator and driven by the magnetic attraction force or the elastic force of the electromagnetic actuator to move between the retracted position and the extended position.

4. The waste discharge device of claim 1, wherein the valve element comprises:

a first stationary plate and a second stationary plate, each of the first and second stationary plates having a through-hole aligned with the discharge opening of the wastewater tank;

a rotatable plate interposed between the first and second stationary plates, the rotatable plate having a through-hole, wherein an alignment of the through-hole of the rotatable plate with the through-holes of the first and second stationary plates controls the open state of the valve element, and a misalignment of the through-hole of the rotatable plate with the through-holes of the first and second stationary plates controls the closed state of the valve element.

5. The waste discharge device of claim 4, wherein the rotatable plate is made of ceramic, and the first and second stationary plates are made of Polytetrafluoroethylene.

6. The waste discharge device of claim 4, wherein the valve element further comprising a sealing plate interposed between an external bottom surface of the wastewater tank and the first stationary plate, the sealing plate having a through-hole aligned with the discharge opening of the wastewater tank.

7. The waste discharge device of claim 4, wherein the valve element further comprises:

a second actuator comprising a second motor and a second transmission mechanism mechanically connected to the second motor, and being configured for driving a rotational movement of the rotatable plate relative to the first and second stationary plates;

wherein the second motor is controlled based on a result of detecting whether the through-hole of the rotatable plate aligns with the through-holes of the first and second stationary plates.

8. The waste discharge device of claim 1, further comprising a waste crushing mechanism mounted inside the wastewater tank, the waste crushing mechanism comprising:

a third motor configured to provide a rotation torque;

a set of blades configured to be driven by the rotation torque of the third motor to scrape off the solidified waste formed on an internal bottom surface of the wastewater tank, such that the solidified waste generated from the distillation of the wastewater is discharged through the discharge opening of the wastewater tank by gravity feed.

9. The waste discharge device of claim 1, wherein:

the valve element is mounted on an external bottom surface of the wastewater tank; and the telescopic mechanism is disposed above the discharge opening inside the wastewater tank or disposed below the discharge opening outside the wastewater tank, and movable vertically between the retracted position and the extended position.

10. A docking station for a cleaning robot, the docking station comprising:

a wastewater tank configured to collect wastewater and having a discharge opening at its bottom; and a waste discharge device comprising:

a valve element mounted at a position corresponding to the discharge opening, the valve element being operable in an open state for uncovering the discharge opening or a closed state for covering the discharge opening; and a solid waste breaking mechanism configured to be actuated while the valve element is in the open state to break through solidified waste generated from distillation of the wastewater and formed at the discharge opening such that the solidified waste generated from distillation of the wastewater is discharged through the discharge opening of the wastewater tank, wherein the solid waste breaking mechanism is a telescopic mechanism movable between a retracted position and an extended position relative to the discharge opening, and the waste discharge device further comprises a processor configured to:

control the valve element to be in the closed state and control the telescopic mechanism to be in the retracted position, such that the solidified waste is not discharged, control the valve element to be in the open state and actuate the telescopic mechanism from the retracted position to the extended position, such that the solidified waste is discharged, wherein the telescopic mechanism is controlled to be guided through the discharge opening by extending to a full length of the telescopic mechanism at the extended position to penetrate the solidified waste generated from distillation of the wastewater and formed at the discharge opening.

11. The docking station of claim 10, wherein the collected wastewater is heated for generating clean water.

12. The docking station of claim 11, wherein heating is controlled based on a detected temperature of the wastewater heated in the wastewater tank to maintain the wastewater at a predetermined temperature below a boiling point.

13. The docking station of claim 11, wherein the wastewater tank further comprises:

a first metal contact mounted on an internal bottom surface of the wastewater tank; and a second metal contact mounted on an internal side wall of the wastewater tank at a first height corresponding to a water level upper limit, wherein the collection of the wastewater in the wastewater tank is controlled based on a first conductive state between the first metal contact and the second metal contact.

14. The docking station of claim 13, wherein the wastewater tank further comprises:

a third metal contact mounted on the internal side wall of the wastewater tank at a second height higher than the first height and corresponding to a boiling point water level, wherein heating is controlled based on a second conductive state between the first metal contact and the third metal contact to maintain the wastewater at a predetermined temperature below a boiling point.

15. The docking station of claim 14, wherein the wastewater tank further comprises:

a fourth metal contact mounted on the internal bottom surface of the wastewater tank, wherein the heating is controlled further based on a third conductive state between the first metal contact and the fourth metal contact to prevent the wastewater from drying out.

16. The docking station of claim 11, wherein the wastewater tank further comprises:

a bimetallic switch including a first metal plate and a second metal plate with different temperature coefficients, wherein heating is controlled with the aid of the bimetallic switch in response to different thermal deformations of the first metal plate and the second metal plate.

17. The docking station of claim 11, wherein the clean water is generated from water vapor produced by heating of the collected wastewater and/or water vapor originated from moisture in air.

18. The docking station of claim 10, wherein the waste discharge device further comprising a waste crushing mechanism mounted inside the wastewater tank, the waste crushing mechanism comprising:

a third motor configured to provide a rotation torque;

a set of blades configured to be driven by the rotation torque of the third motor to scrape off the solidified waste formed on an internal bottom surface of the wastewater tank, such that the waste generated from the distillation of the wastewater is discharged through the discharge opening of the wastewater tank by gravity feed.

19. The docking station of claim 18, wherein the waste crushing mechanism further comprises:

a rotating plate mounted on a first end of a rotating shaft of the third motor, wherein a magnet is mounted on an edge of the rotating plate and rotates together with the set of blades mounted on a second end of the rotating shaft opposite to the first end;

a magnetic sensing element mounted on an internal side wall of the wastewater tank at a height corresponding to the rotating plate and within a threshold distance to the rotating plate, wherein a position of the set of blades is controlled based on a result of detecting the magnet by the magnetic sensing element during rotation of the set of blades.

20. A method of operating a docking station of a cleaning robot, the docking station having a wastewater tank with a discharge opening at its bottom, the method comprising:

collecting wastewater in the wastewater tank;

distilling the wastewater stored in the wastewater tank for generating clean water;

controlling a valve element to be in an open state for uncovering the discharge opening, the valve element being mounted at a position corresponding to the discharge opening, the valve element is operable to be in a closed state for covering the discharge opening; and actuating a solid waste breaking mechanism while the valve element is in the open state to break through solidified waste generated from distillation of the wastewater and formed at the discharge opening such that the solidified waste generated from distillation of the wastewater is discharged through the discharge opening of the wastewater tank, wherein the solid waste breaking mechanism is a telescopic mechanism movable between a retracted position and an extended position relative to the discharge opening, and the method further comprising:

controlling the valve element to be in the closed state and controlling the telescopic mechanism to be in the retracted position, such that the solidified waste is not discharged;

controlling the valve element to be in the open state and actuating the telescopic mechanism from the retracted position to the extended position, such that the solidified waste is discharged, wherein the telescopic mechanism is controlled to be guided through the discharge opening by extending to a full length of the telescopic mechanism at the extended position to penetrate the solidified waste generated from distillation of the wastewater and formed at the discharge opening.

21. A cleaning system, comprising:

a cleaning robot configured to perform a cleaning task; and a docking station for the cleaning robot, the docking station comprising:

a wastewater tank configured to collect wastewater and having a discharge opening at its bottom; and a waste discharge device comprising:

a valve element mounted at a position corresponding to the discharge opening, the valve element being operable in an open state for uncovering the discharge opening or a closed state for covering the discharge opening; and a solid waste breaking mechanism configured to be actuated while the valve element is in the open state to break through solidified waste generated from distillation of the wastewater and formed at the discharge opening such that the solidified waste generated from distillation of the wastewater is discharged through the discharge opening of the wastewater tank, wherein the solid waste breaking mechanism is a telescopic mechanism movable between a retracted position and an extended position relative to the discharge opening, and the waste discharge device further comprises a processor configured to:

control the valve element to be in the closed state and control the telescopic mechanism to be in the retracted position, such that the solidified waste is not discharged;

control the valve element to be in the open state and actuate the telescopic mechanism from the retracted position to the extended position, such that the solidified waste is discharged, wherein the telescopic mechanism is controlled to be guided through the discharge opening by extending to a full length of the telescopic mechanism at the extended position to penetrate the solidified waste generated from distillation of the wastewater and formed at the discharge opening.

* * * * *